US007589273B2

(12) United States Patent
Uehara

(10) Patent No.: US 7,589,273 B2
(45) Date of Patent: Sep. 15, 2009

(54) MUSICAL INSTRUMENT AND AUTOMATIC ACCOMPANYING SYSTEM FOR HUMAN PLAYER

(75) Inventor: Haruki Uehara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 162 days.

(21) Appl. No.: 11/940,728

(22) Filed: Nov. 15, 2007

(65) Prior Publication Data

US 2008/0168892 A1 Jul. 17, 2008

(51) Int. Cl.
*G10H 1/36* (2006.01)

(52) U.S. Cl. ..... 84/610; 84/609; 84/615; 84/620; 84/634

(58) Field of Classification Search ..... None
See application file for complete search history.

(56) References Cited

U.S. PATENT DOCUMENTS 5,583,310 A 12/1996 Sugiyama et al.
7,268,289 B2 * 9/2007 Muramatsu et al. ..... 84/719
7,420,116 B2 * 9/2008 Fujiwara ..... 84/619
2001/0007221 A1 7/2001 Uehara
2002/0178898 A1 12/2002 Hagiwara et al.
2005/0150361 A1 * 7/2005 Muramatsu et al. ..... 84/626
2006/0196346 A1 * 9/2006 Ohba et al. ..... 84/616
2006/0213357 A1 * 9/2006 Ohba ..... 84/723

FOREIGN PATENT DOCUMENTS

JP 2001195063 A 7/2001
WO 98/58364 12/1998

* cited by examiner

*Primary Examiner*—Marlon T Fletcher
(74) *Attorney, Agent, or Firm*—Harness, Dickey & Pierce, PLC

(57) ABSTRACT

An automatic accompanist produces tones for an accompaniment in synchronism with tones of melody produced through fingering of a human player; cue note data codes, which express tones produced in the melody, and cue time data codes, which express a lapse of time between the cue notes, are stored in a cue time track separately from an automatic accompanying track where key event data codes for the accompaniment and duration data codes each expressing a lapse of time between the key event codes; while the human player is fingering the melody, the automatic accompanist monitors the keys specified as the cue notes; if the human player does not depress the keys, the automatic accompanist stops the measurement of the lapse of time expressed by the duration data codes so as to make the accompaniment delayed.

20 Claims, 18 Drawing Sheets

| Sorts of Data | Delta Time | Key Event | Note Number | Key Velocity |
|---|---|---|---|---|
| Duration | 0 | | | |
| Event | | On | 60 | 64 |
| Duration | 0 | | | |
| Event | | On | 64 | 64 |
| Duration | 0 | | | |
| Event | | On | 67 | 64 |
| Duration | 480 | | | |
| Event | | Off | 60 | |
| Duration | 0 | | | |
| Event | | Off | 64 | |
| Duration | 0 | | | |
| Event | | Off | 67 | |
| Duration | 0 | | | |
| Event | | On | 60 | 64 |
| Duration | 0 | | | |
| Event | | On | 64 | 64 |
| Duration | 0 | | | |
| Event | | On | 67 | 64 |
| Duration | 480 | | | |
| Event | | Off | 60 | |
| Duration | 0 | | | |
| Event | | Off | 64 | |
| Duration | 0 | | | |
| Event | | Off | 67 | |

Fig. 7A

| | | | | |
|---|---|---|---|---|
| Duration | 0 | | | |
| Event | | On | 60 | 64 |
| Duration | 0 | | | |
| Event | | On | 65 | 64 |
| Duration | 0 | | | |
| Event | | On | 69 | 64 |
| Duration | 480 | | | |
| Event | | Off | 60 | |
| Duration | 0 | | | |
| Event | | Off | 65 | |
| Duration | 0 | | | |
| Event | | Off | 69 | |

Fig. 7 B

| Sorts of Data | Cue Time | Cue Note | Note Number | Key Velocity |
|---|---|---|---|---|
| Duration | 0 | | | |
| Quasi-Event | | Defined | 60 (Cue note 1) | |
| Duration | 960 | | | |
| Quasi-Event | | Defined | 69 (Cue note 2) | |

Fig. 7 C

Tr 1

| Sorts of Data | Delta Time | Key Event | Note Number | Key Velocity |
|---|---|---|---|---|
| Duration | 0 | | | |
| Event | | On | 60 | 64 |
| Duration | 0 | | | |
| Event | | On | 64 | 64 |
| Duration | 0 | | | |
| Event | | On | 67 | 64 |
| Duration | 480 | | | |
| Event | | Off | 60 | |

Tr 15

| Sorts of Data | Cue Time | Cue Note | Note Number | Key Velocity |
|---|---|---|---|---|
| Duration | 0 | | | |
| Quasi-Event | | Defined | 60 (Cue note 1) | |
| Duration | 960 | | | |
| Quasi-Event | | Defined | 69 (Cue note 2) | |

Tr 14

| Sorts of Data | Cue Time | Cue Note | Note Number | Key Velocity |
|---|---|---|---|---|
| Duration | 30,240 | | | |
| Quasi-Event | | Defined | 64 (Cue note 101) | |

Fig. 14

MUSICAL INSTRUMENT AND AUTOMATIC ACCOMPANYING SYSTEM FOR HUMAN PLAYER

FIELD OF THE INVENTION

This invention relates to a musical instrument and, more particularly, to a musical instrument and an automatic accompanying system for a human player performing a music tune on the musical instrument.

DESCRIPTION OF THE RELATED ART

An automatic player piano is a typical example of the hybrid keyboard musical instrument, i.e., a combination between the acoustic piano and an electronic system for automatic performance. While the music data codes, which express a performance along a music tune, are sequentially being supplied to the electronic system, the electronic system makes the black keys and white keys selectively depressed and released as the automatic player, and the tones are produced through the acoustic piano along the music tune.

Additional capabilities have been given to the electronic system. For example, a prior art electronic system can give an accompaniment to a performance of a human player. The system with this capability is hereinafter referred to as an "automatic accompanist" or as "an automatic accompanying system.

Some beginners feel a concurrent performance on a melody and the accompaniment with both hands difficult. For these beginners, the automatic accompanist produces the piano tones except for those in the melody, and the beginner fingers on the piano keyboard along the melody.

However, the beginner tends to retard the fingering. A countermeasure is proposed in Japan Patent Application laid-open No. 2001-195063. As disclosed in the Japan Patent Application laid-open, selected ones of the music data codes for the melody and associated music data codes for the accompaniment are labeled with cue data coded, and the prior art automatic accompanist interrupts the accompaniment at the music data codes labeled with the cue data codes if the prior art automatic accompanist finds the beginner not to produce the associated tones on the melody. When the beginner depresses the keys for the associated tones, the prior art automatic accompanist acknowledges that the beginner catches up the automatic accompanist, and resumes the accompaniment.

A problem is encountered in the prior art automatic accompanist in that accomplished pianists feel the automatic accompaniment not to accord with the melody.

SUMMARY OF THE INVENTION

It is therefore an important object of the present invention to provide a musical instrument, a built-in automatic accompanying system of which timely produces tones in the accompaniment for a human player.

It is also an important object of the present invention to provide an automatic accompanying system, which makes users feel a part of a music tune to accord with another part of the music tune performed by a human player.

The present inventor contemplated the problem inherent in the prior art automatic accompanying system, and noticed that 10 odd milliseconds lapses away from the detection of depressed keys and the resumption of the accompaniment. The present inventor concluded that the delay time made the accomplished players feel the accompaniment not to accord with the melody produced through the fingering of beginner.

To accomplish the object, the present invention proposes to monitor the link-works, which are activated by a human player, so as to retard accompaniment, if necessary.

In accordance with one aspect of the present invention, there is provided a musical instrument for performing a music tune comprising plural link-works selectively actuated by a human player so as to specify an attribute of tones to be produced and tone producing moments at which the tones are produced, a tone generator connected to the plural link-works so as to produce the tones at the moments and an automatic accompanying system, which includes a data storage storing pieces of music data expressing accompanying tones to be produced, pieces of time data expressing accompanying tone producing moments to produce the accompanying tones, pieces of cue note data expressing selected ones of the tones to be produced by the human player and pieces of cue time data expressing the tone producing moments at which the human player is expected to produce the selected ones of the tones, a first time keeper connected to the data storage so as to read out the pieces of cue note data and the pieces of cue time data and monitoring the link-works expressed by the pieces of the cue note data so as to produce pieces of control data expressing whether or not the human player activates the link-works at or before the tone producing moments expressed by the pieces of cue time data, a second time keeper connected to the tone generator and the data storage so as to read out the pieces of music data and the pieces of time data and supplying the pieces of music data to the tone generator for causing the tone generator to produce the accompanying tones when the accompanying tone producing moments come, and an interrupter connected to the first time keeper and the second time keeper and responsive to the pieces of control data so as to interrupt the passage of time toward the accompanying tone producing moments while the answer of the first time keeper is being given negative.

In accordance with another aspect of the present invention, there is provided an automatic accompanying system for producing accompanying tones to a music passage performed by a human player on a musical instrument comprising a data storage storing pieces of music data expressing the accompanying tones, pieces of time data expressing accompanying tone producing moments to produce the accompanying tones, pieces of cue note data expressing selected ones of the tones in the music passage and pieces of cue time data expressing tone producing moments at which the human player is expected to produce the selected ones of the tones, a first time keeper connected to the data storage so as to read out the pieces of cue note data and the pieces of cue time data and monitoring link-works of the musical instrument expressed by the pieces of the cue note data so as to produce pieces of control data expressing whether or not the human player activates the link-works at or before the tone producing moments expressed by the pieces of cue time data, a second time keeper connected to the tone generator and the data storage so as to read out the pieces of music data and the pieces of time data and supplying the pieces of music data to the tone generator for causing the tone generator to produce the accompanying tones when the accompanying tone producing moments come, and an interrupter connected to the first time keeper and the second time keeper and responsive to the pieces of control data so as to interrupt the passage of time toward the accompanying tone producing moments while the answer of the first time keeper is being given negative.

BRIEF DESCRIPTION OF THE DRAWINGS

The features and advantages of the musical instrument and automatic accompanying system will be more clearly understood from the following description taken in conjunction with the accompanying drawings, in which

FIGS. 7A and 7B are views showing key event data codes and duration data codes stored in an accompaniment track, FIG. 7C is a view showing cue data codes and cue time codes stored in a cue time track, FIG. 11 is a graph showing loci of depressed key and a concept of adjusting work in yet another automatic player piano of the present invention, FIG. 14 is a view showing tracks of a music data file processed in the automatic player piano shown in FIG. 13.

DESCRIPTION OF THE PREFERRED EMBODIMENTS

Figure 1:
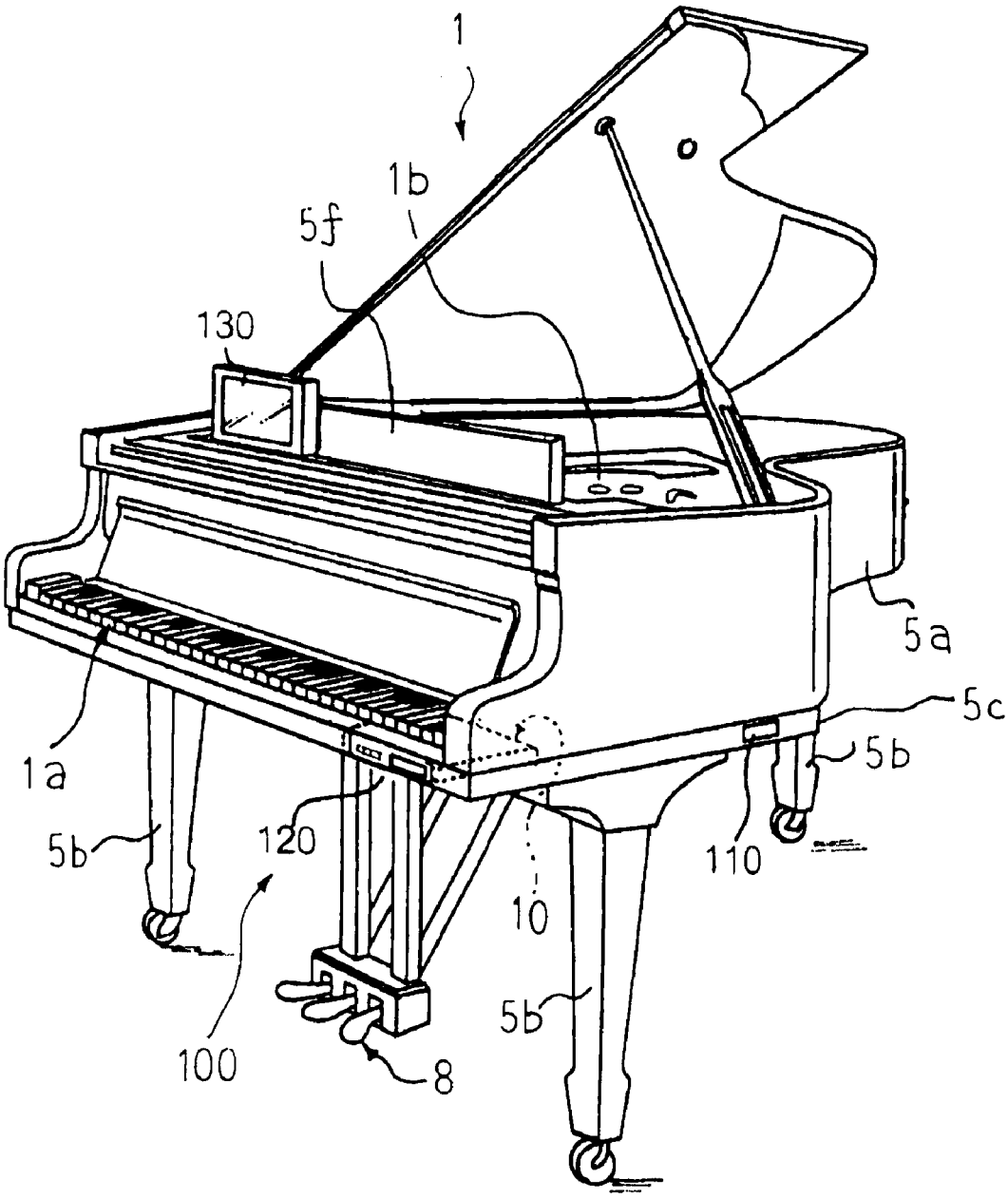
FIG. 1 is a perspective view showing an automatic player piano of the pre-sent invention.

A human player performs a music tune on a musical instrument embodying the present invention. The musical instrument comprises plural link-works, a tone generator and an automatic accompanying system. The human player selectively actuates the plural link-works so as to play the music tune, and the automatic accompanying system produces accompanying tones to the music tune without any fingering of the human player.

The human player selectively activates the plural link-works so as to specify an attribute of tones to be produced and tone producing moments at which the tones are produced. The plural link-works are connected to the tone generator, and the tone generator is responsive to the activated link-works so as to produce the tones at the moments. Thus, the human player performs the music tune on the array of plural link-works as similar to those who perform music tunes on a piano, by way of example.

The automatic accompanying system includes a data storage, a first time keeper, a second time keeper and an interrupter. The first time keeper, second time keeper and interrupter are realized through execution of a computer program.

Pieces of music data expressing accompanying tones to be produced, pieces of time data expressing accompanying tone producing moments to produce the accompanying tones, pieces of cue note data expressing selected ones of the tones to be produced by the human player and pieces of cue time data expressing the tone producing moments at which the human player is expected to produce the selected ones of the tones are stored in the data storage.

The first time keeper is connected to the data storage so as to read out the pieces of cue note data and the pieces of cue time data. The first time keeper specifies the link-works expressed by the pieces of the cue note data, and monitors the link-works to see whether or not the human player activates the link-works. The first time keeper produces pieces of control data expressing whether or not the human player activates the link-works at or before the tone producing moments expressed by the pieces of cue time data. The first time keeper is connected to the interrupter, and supplies the pieces of control data to the interrupter.

The second time keeper is connected to the tone generator and the data storage. The second time keeper reads out the pieces of music data and the pieces of time data from the data storage, and supplies the pieces of music data to the tone generator when the accompanying tone producing moments come. Thus, the second time keeper causes the tone generator to produce the accompanying tones.

The interrupter is further connected to the second time keeper. The first time keeper is supplying the pieces of control data to the interrupter as described hereinbefore. The interrupter is responsive to the pieces of control data so as to interrupt the passage of time toward the accompanying tone producing moments while the answer of the first time keeper is being given negative. For this reason, if the human player intentionally or unintentionally retards the activation of the link-works, the interrupter does not permit the tone generator to produce the accompanying tones through the interruption. When the human player activates the link-works specified by the pieces of cue note data, the answer of first time keeper is changed to affirmative, and the interrupter permits the second time keeper to transfer the pieces of music data to the tone generator at the accompanying tone producing moments.

As will be appreciated from the foregoing description, the first time keeper and interrupter cooperate with the second time keeper so as to transfer the pieces of music data to the tone generator at timing proper to the tones in the music tune performed by the human player. Thus, the automatic accompanying system makes the accompaniment synchronized with the music tune.

In the following description, term "front" is indicative of a position closet to a human pianist, who gets ready for play a tune, than another position modified with term "rear". A line drawn between a front position and a corresponding rear position extends in a "longitudinal direction", and a "lateral direction" crosses the longitudinal direction at right angle. An up-and-down direction" is normal to a virtual plane defined by the longitudinal direction and the lateral direction.

First Embodiment

Referring first to FIG. 1 of the drawings, an automatic player piano embodying the present invention largely comprises a grand piano 1 and an electronic system 100. The grand piano 1 produces acoustic piano tones in response to fingering of a human player. The electronic system 100 behaves as an automatic player and an automatic accompanist, and the automatic player and automatic accompanist produces the acoustic piano tones without any fingering of the human player. The electronic system 100 has an information processing capability, and a computer program is installed in the electronic system 100. The automatic player and automatic accompanist are realized through execution of the computer program. The automatic player is same in system configuration as the automatic accompanist. However, a subroutine program for the automatic player is different from a subroutine program for the automatic accompanist.

The grand piano 1 includes a keyboard 1*a*, a tone generating system 1*b*, a piano cabinet 5*a* and legs 5*b*. The legs 5*b* downwardly project from the piano cabinet 5*a*, and keep the piano cabinet 5*a* spaced from a floor in the up-and-down direction. The keyboard 1*a* is mounted on a front portion of the piano cabinet 5*a*, and is exposed to a human player for fingering. An inner space is defined inside the piano cabinet 5*a*, and the tone generating system 1*b* is provided in the inner space. The keyboard 1*a* is connected to the tone generating system 1*b*, and the tone generating system 1*b* is responsive to the fingering on the keyboard 1*a* so as to produce the acoustic piano tones. The electronic system 100 is partially installed in the inner space, and is partially provided on the outer surface of the piano cabinet 5*a*.

Figure 2:
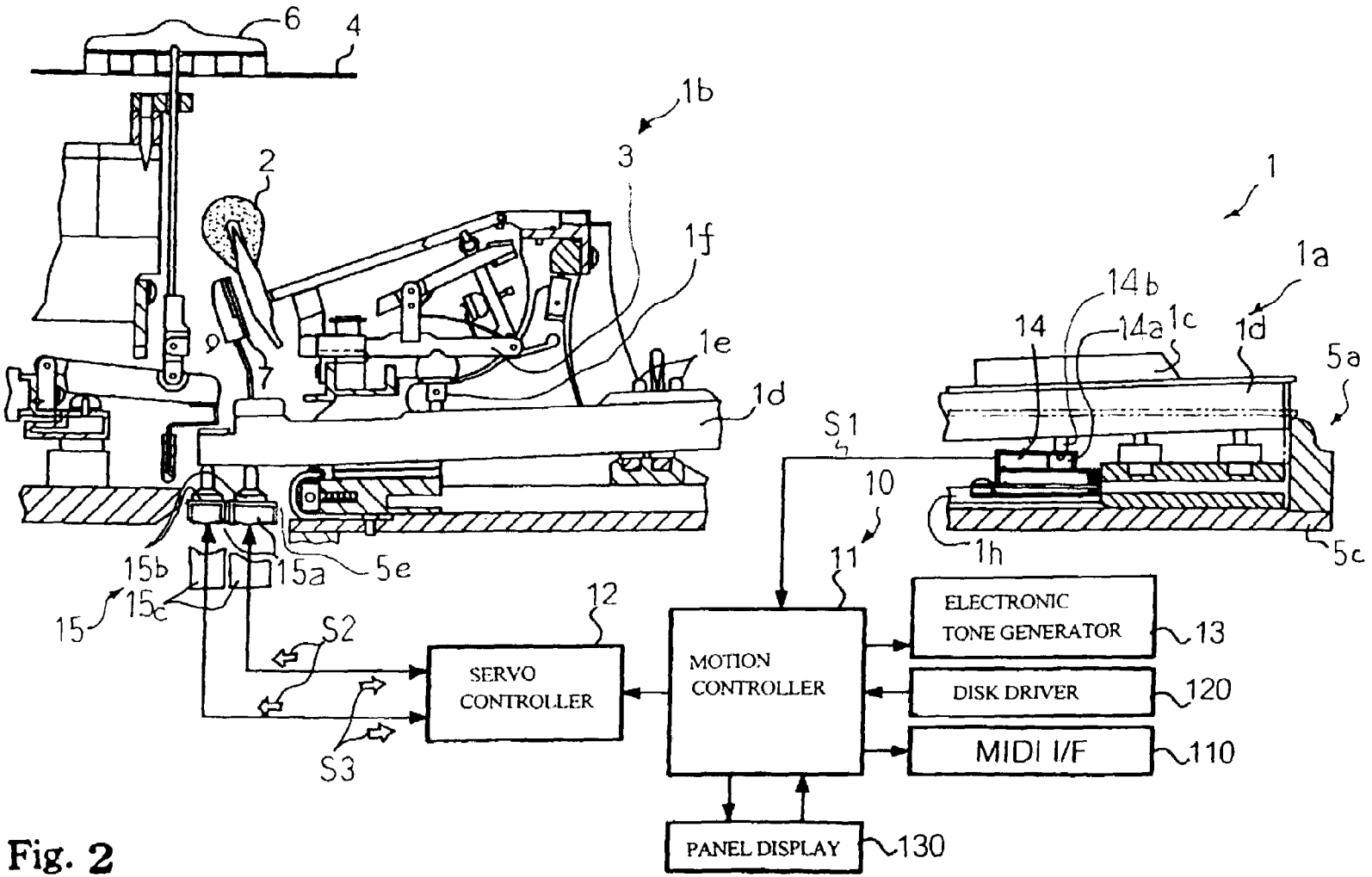
FIG. 2 is a schematic cross sectional view showing the structure of a grand piano and the system configuration of an electronic system.

Turning to FIG. 2 of the drawings, the keyboard 1*a* is mounted on a front portion of a key bed 5*c*, which forms the bottom of the piano cabinet 5*a*, and has black keys 1*c* and white keys 1*d*. Pitch names are assigned to the black keys 1*c* and white keys 1*d*. The black keys 1*c* and white keys 1*d* are laid on a well-known pattern in the lateral direction, and independently pitch up and down. Balance key pins 1*e* offer fulcrums to the black keys 1*c* and white keys 1*d*, respectively.

The tone generating system 1*b* includes hammers 2, action units 3, strings 4, dampers 6, back checks 7 and a pedal system 8 (see FIG. 1). The action units 3 are provided over the rear portions of the black and white keys 1*c*/1*d*, and capstan screws 1*f*, which upwardly project from the rear portions of the black and white keys 1*c*/1*d*, are held in contact with the action units 3, respectively. The hammers 2 are provided over the action units 3, and the action units 3 give rise to the rotation of the associated hammers 2. The weight of the hammers 2 and action units 3 is exerted on the capstan screws 1*f*, and produces moment in the counter clockwise direction. For this reason, the front portions of black and white keys 1*c*/1*d* float over the key bed 5*c* in so far as any other external force is not exerted, and the key positions are referred to as "rest positions".

When the front positions of black and white keys 1*c*/1*d* are downwardly depressed with force, which makes the moment in the clockwise direction larger than the moment in the counter clockwise direction, the black and white keys 1*c*/1*d* starts to travel from the rest positions toward the key bed 5*c*. The depressed keys 1*c*/1*d* cause the associated action units 3 to escape from the associated hammer 2 at certain points on the trajectories, and give rise to rotation of associated hammers 2. When the black and white keys 1*c*/1*d* stop, the black and white keys 1*c*/1*d* reach "end positions", respectively.

The strings 4 are stretched over the hammers 2, and the hammers 2 are brought into collision with the strings 4 at the end of the rotation. Thus, the black and white keys 1*c*/1*d* are linked with the hammers 2 through the action units 3, respectively, and are corresponding to the strings 4, respectively.

The dampers 6 are connectable to the rearmost portions of the black and white keys 1*c*/1*d*. While the black and white keys 1*c*/1*d* are staying at the rest positions, the dampers 6 are held in contact with the strings 4, and do not permit the associated strings 4 to vibrate. While the black and white keys 1*c*/1*d* are traveling from the rest positions toward the end positions, the rearmost portions of black and white keys 1*c*/1*d* start upwardly to press the dampers 6 at certain points on the way to the end positions. The dampers 6 are spaced from the strings 4, and permit the strings 4 to vibrate.

When the hammers 2 are brought into collision with the associated strings 4, the hammers 2 give rise to vibrations of the strings 4, and the acoustic tones are produced through the vibrations of strings 4 at the pitch names.

The hammers 2 rebound on the strings 4 immediately after the collision, and are received by the back checks 7. The back checks 7 do not permit the hammers 2 to rebound thereon, and prevent the strings 4 from double strike. When the force is removed from the depressed keys 1*c*/1*d*, the self-weight of hammers 2 and action units 3 causes the rear portions of black and white keys 1*c*/1*d* to be downwardly moved so that the black and white keys 1*c*/1*d* return to the rest positions.

The pedal system 8 has pedals selectively linked with the dampers 6 and keyboard 1*a*. The pedal system 8 makes the loudness of acoustic piano tones lessened and the acoustic piano tones prolonged.

The electronic system 100 includes an information processor 10, an electronic tone generator 13, key sensors 14, solenoid-operated key actuators 15, an MIDI interface 110, which is abbreviated as "MIDI/IF" in FIG. 2, a disk driver 120 and a panel display 130. "MIDI" is an abbreviation of "Musical Instrument Digital Interface", and is a registered trademark. Though not shown in the drawings, the information processor 10 is connected to the electronic tone generator 13, key sensors 14, solenoid-operated key actuators 15, MIDI interface 110, disk driver 120 and panel display 130 through cables.

The information processor 10 is the origin of the data processing capability. Though not shown in the drawings, the information processor 10 includes a central processing unit, peripheral processors such as, for example, a direct memory access controller, a read only memory, a random access memory, signal interfaces, a mass storage device such as, for example, a hard disk unit and a shared bus system. The central processing unit, read only memory and random access memory are usually abbreviated as "CPU", "ROM" and "RAM", respectively. The shared bus system is connected to the central processing unit, peripheral processors, read only memory, random access memory, signal interfaces and mass storage device, and permits the central processing unit to communicate with the peripheral processors, read only memory, random access memory, signal interfaces and mass storage device.

A computer program, default control parameters and data tables are stored in the read only memory, and the computer program runs on the central processing unit for achieving given tasks. While the central processing unit is executing the computer program, the random access memory serves as a temporary data storage. Plural registers are defined in the random access memory, and are respectively assigned to the black and white keys 1c/1d. Pieces of key position data for each key 1c/1d are stored in one of the registers. The central processing unit periodically checks the registers to see whether or not any one of the black and white keys 1c/1d is depressed and whether or not any one of the depressed keys 1c/1d is released. A cue flag is defined in the random access memory. While the cue flag is being raised, the accompaniment is interrupted as will be hereinlater described.

The peripheral processors execute respective computer programs under the control of the central processing unit. For example, one of the peripheral processors transfers a set of MIDI music data codes from the hard disk to the random access memory before an automatic playing.

Some of the signal interfaces are connected to the key sensors 14, and analog-to-digital converters are respectively incorporated in the signal interface assigned to the key sensors 14. Other signal interfaces and yet other signal interfaces are assigned to the solenoid-operated key actuators 15 for servo control. The other signal interfaces have respective analog-to-digital converters, and pulse width modulators are incorporated in the yet other signal interfaces as will be described hereinlater.

The computer program is broken down into a main routine program and subroutine programs. The automatic playing is realized through the execution of one of the subroutine programs, and is hereinafter referred to as "an automatic playing subroutine program". Another subroutine program expresses a sequence of jobs for the automatic accompaniment, and is hereinafter referred to as "an automatic accompanying subroutine program". The information processor, automatic playing subroutine program and solenoid-operated key actuators 15 serve as the automatic player, and the information processor, automatic accompanying subroutine program, key sensors 14 and solenoid-operated key actuators are essential components of the automatic accompanist. The automatic playing subroutine program and automatic accompanying subroutine program are hereinlater described in detail.

The electronic tone generator 13 has plural channels and waveform memories, and pieces of waveform data are stored in the waveform memories. When MIDI music data codes, which express note-on events for different note names, arrive at the electronic tone generator 13, selected ones of the channels are respectively assigned to the MIDI music data codes, and the pieces of waveform data are sequentially read out from the waveform memories through the channels. The pieces of waveform data are formed into an audio signal, and the audio signal is supplied from the electronic tone generator 13 to a sound system (not shown) so as to radiate electronic tones from the sound system.

The MIDI music data code expressing a note-on event is hereinafter referred to as a "note-on event data code". A "note-off event data code" is the MIDI music data code expressing a note-off event, and both of the note-on event data code and note-off event data codes are simply called as a "key event data code". A "duration code" expresses a lapse of time between an event and the next event. The lapse of time is expressed as the number of tempo clocks, and the tempo is determined by using the quarter note as the unit. Assuming now that the tempo is adjusted to 120, the unit time is equivalent to 0.5 second. If the quarter note is equivalent to 480, each clock pulse is corresponding to 1/960 second. In this situation, when a duration code expresses 960, the next event is to take place 1 second after the event.

The key sensors 14 are provided on a key frame 1h under the front portions of the black and white keys 1c/1d. In this instance, an optical position transducer is employed as the key sensor 14. The optical position transducers include light emitting diodes (not shown), light detecting diodes (not shown), sensor heads 14a, optical fibers (not shown) selectively connected between the sensor heads 14a and the light emitting diodes/light detecting diodes and shutter plates 14b. The shutter plates 14b are secured to the lower surfaces of the black and white keys 1c/1d, and downwardly project from the associated black and white keys 1c/1d. The shutter plates 14b travel along trajectories together with the associated black and white keys 1c/1d. The sensor heads 14a are provided on both sides of each trajectory, and each of the sensor heads 14a is shared between two shatter plates 14b adjacent to each other except for the rightmost sensor head 14a and leftmost sensor head 14a. Each of the light emitting diodes supplies light through the optical fibers to selected ones of the sensor heads 14a, and the light beams are radiated from these sensor heads 14a to the adjacent sensor heads 14a across the trajectories, and the incident light is propagated through the optical fibers to the light detecting diodes so as to be converted to photocurrent. Since the light emitting diodes are sequentially energized, the light is periodically radiated across all the trajectories.

Figure 3A:
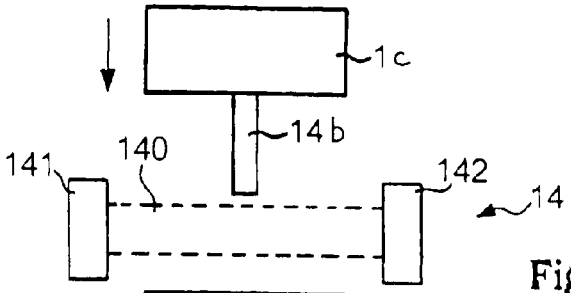
FIGS. 3A to 3C are schematic front views showing a key sensor for converting a key position to a key position signal.
Figure 3B:
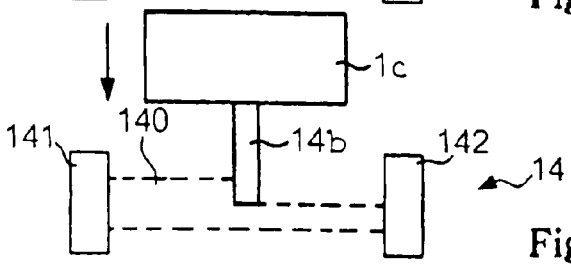
Figure 3C:
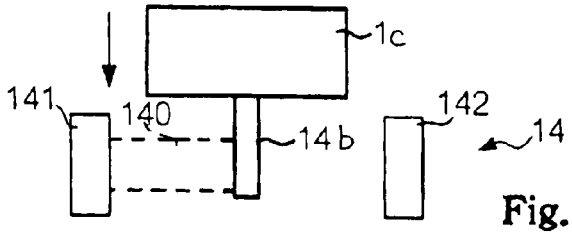

Turning to FIGS. 3A to 3C, one of the key sensors 14 monitors one of the black keys 1c, and the light beam is labeled with reference numeral 140. The sensor head 14a, from which the light beam 140 is radiated, is labeled with reference numeral 141, and the sensor head, on which the light beam 140 is incident, is labeled with reference numeral 142.

While the black key 1c is staying at the rest positions, the shutter plate 14b stays over the light beam 140 as shown in FIG. 3A, and the light beam 140 have the widest cross section. For this reason, the amount of photocurrent is maximized.

While the black key 1c is traveling along the trajectory toward the end position, the shutter plate 1b gradually intersects the light beam 140 as shown in FIG. 3B, and, accordingly, the amount of photocurrent is reduced.

When the black key 1c reaches the end position, the shutter plate 14b intersects the light beam 140, and does not permit the light beam 140 to reach the sensor head 142. As a result, the amount of photocurrent is minimized.

Figure 4A:
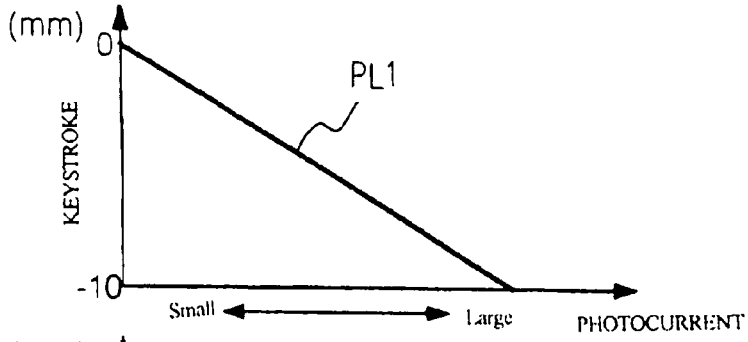
FIG. 4A is a graph showing a relation between a keystroke and the amount of photocurrent.
Figure 4B:
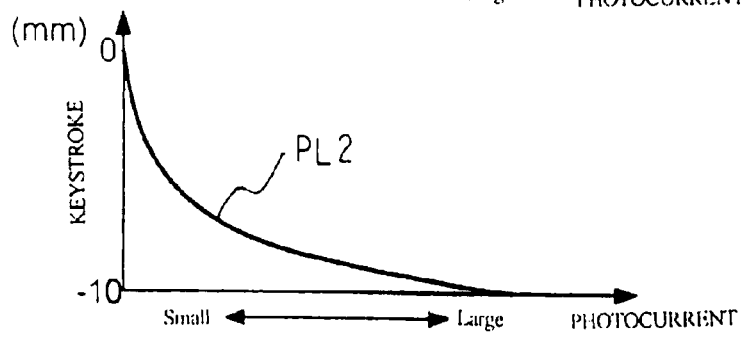
FIG. 4B is a graph showing another relation employable for the key sensors.

Thus, the key positions are converted to the amount of photocurrent by means of the key sensors 14. The photocurrent is converted to a potential level equivalent thereto through suitable current-to-voltage converters (not shown), and key position signals S1 are supplied from the key sensors 14 to the information processor 10. In this instance, the amount of photocurrent, i.e., the potential level of key position signals S1 is linearly varied as indicated by plots PL1 in FIG. 4A. However, the amount of photocurrent may be non-linearly varied as indicated by plots PL2 in FIG. 4B. In case where the amount of photocurrent is non-linearly varied as indicated by plots PL2, the resolution in the vicinity of the end positions is enhanced.

The solenoid-operated key actuators 15 are provided under the rear portions of the black and white keys 1c/1d, and are arranged in staggered manner in the lateral direction. The solenoid-operated key actuators 15 have respective solenoids 15a and respective plungers 15b, and the solenoids 15a are connected to the pulse width modulators of signal interfaces. Driving pulse signals S2 are supplied from the pulse width modulators to the solenoids 15a of solenoid-operated key actuators 15 associated with the black and white keys 1c/1d to be driven. The pulse width modulators can vary the duty ratio of driving pulse signals S2, and, accordingly, the magnetic force, which is exerted on the plungers 15b, is variable.

The plungers 15*b* are monitored by built-in plunger sensors 15*c*, respectively. The plunger sensors 15*c* convert the velocity of plungers 15*b* to plunger velocity signals S3, and supply the plunger velocity signal S2 to the information processor 10. The information processor 10 carries out the servo control with the driving pulse signal S2 on the basis of the plunger velocity signals S3.

A slot 5*e* is formed in the key bed 5*c*, and extends in the lateral direction. The solenoid-operated key actuators 15 are supported by the key bed 5*c* in such a manner that the plungers 15*b* pass through the slot 5*e*. The plungers 15*b* have respective tips beneath the lower surfaces of the rearmost portions of black and white keys 1*c*/1*d*. While the driving pulse signal S2 is flowing through the solenoid 15*a*, magnetic field is created around the plunger 15*b*, and the magnetic force is exerted on the plunger so as to make the plunger 15*b* upwardly project. The plunger 15*b* pushes the rear portion of the associated black key 1*c* or white key 1*d* so that the black key 1*c* or white key 1*d* travels along the trajectory without any fingering of a human player.

The MIDI interface 110 is connected to one of the signal interface of the information processor 10. The MIDI interface 110 receives MIDI music data codes from an external source, and supplies the MIDI music data codes to the information processor 10. The MIDI interface 110 further receives MIDI music data codes from the information processor 10, and supplies the MIDI music data codes to an external device. When a user wishes to make an external musical instrument play an accompaniment to a performance on the acoustic piano 1, the MIDI music data codes, which express the accompaniment, are transferred to the external musical instrument through the MIDI interface 110. In this instance, the MIDI interface 110 is fitted to the side portion of the key bed 5*c* as shown in FIG. 1.

The disk driver 120 is connected to another signal interface of the information processor 10, and has a tray on which a CD (Compact Disk) or a DVD (Digital Versatile Disk) is put. Music data files are stored in the CD or DVD for the automatic accompaniment, and users transfer a music data file or files from the CD or DVD to the information processor 10. In this instance, the disk driver 120 is fitted to the front portion of the key bed 5*c* as shown in FIG. 1.

The panel display 130 stands on the piano cabinet 5*a* beside a music rack 5*f*, and is three-dimensionally tiltable. Therefore, a user, who sits on a stool (not shown) for fingering, directs the panel display 130 toward him or her. A liquid crystal panel, a touch sensor and a visual image controller form the panel display 130. The liquid crystal panel has an image forming surface, and the image forming surface is overlapped with the touch sensor. While the main routine program is running on the main routine program, the information processor 10 requests the visual image controller to form pictures on the liquid crystal panel for a dialogue between the information controller 10 and the user. The user pushes an area of touch sensor overlapped with a visual image so as to give an instruction. Then, the information processor 10 determines the area where the user pushed, and acknowledges the instruction. The user requests the automatic player to play a music tune on the acoustic piano through the touch sensor over the visual image of automatic player. When the user requests the automatic accompanist to play the accompaniment to his performance on the keyboard 1*a*, he or she pushes the touch sensor over the visual image of automatic accompanist. Titles of music tunes are offered to the user through another picture, and the user pushes the touch sensor over a title of music tune to be performed.

Turning back to FIG. 2, the information processor 10 realizes a function of the automatic player and automatic accompanist through the execution of automatic playing subroutine program and the execution of automatic accompanying subroutine program. The function is broken down into a motion controller 11 and a servo controller 12.

The note-on event data code contains a piece of music data expressing the key number and key velocity, i.e., the pitch name and loudness of a tone to be produced. Since the loudness is proportional to the final velocity of hammers 2 immediately before the collision with the associated strings 4, and the final hammer velocity is proportional to the velocity of the associated key 1*c*/1*d* at a reference point before the escape. For this reason, the automatic player and automatic accompanist can produce the tone at the target loudness by controlling the key velocity at the reference point. The key velocity at the reference point is hereinafter referred to as "reference forward key velocity". The time at which the note-on event takes place is calculable on the basis of a piece of time data expressed by the duration code. On the other hand, the note-off event data code contains a piece of music data expressing the key number assigned to the key, the tone of which is to be decayed, and the time to decay the tone is calculable on the basis of the piece of time data expressed by the duration code. When the damper 6 is brought into contact with the vibrating string 4, the tone is decayed. The associated key 1*c*/1*d* gives rise to the movement of damper 6. For this reason, the automatic player and automatic accompanist can decay the tone by bringing the released key 1*c*/1*d* to a certain point between the end position and the rest position at the calculated time. The automatic player and automatic accompanist control the movement of key 1*c*/1*d* by means of the solenoid-operated key actuator 15. Thus, the automatic player and automatic accompanist can control the note-on event and note-off event by means of the solenoid-operated key actuators 15.

A set of music data codes is transferred from the disk drive unit 120 to the random access memory in the information processor 10, and the music data codes are sequentially read out from the random access memory. The key event data codes are supplied from the information processor 10 to the motion controller 11 for the automatic playing or automatic accompaniment. The motion controller 11 analyzes the note-on event data code and associated duration code, and determines the reference forward key velocity and target time at which the key 1*c*/1*d* passes through the reference point. The motion controller 11 determines a series of values of target key position before the reference point. The target key position is varied with time. For this reason, each value of target key position is paired with the time at which the key 1*c*/1*d* is to pass through the value of target position. The values of target key position are respectively paired with values of transit time, and the series of values of target key position, which is varied with time, is referred to as "a reference forward key trajectory. The motion controller 11 determines the reference forward key trajectories for the black and white keys 1*c*/1*d* to be moved for generating the acoustic piano tones.

The motion controller 11 further analyzes the note-off event data code and duration data code for a reference backward key trajectory, which is a series of target key position varied with time until the certain key position at which the released key 1*c*/1*d* causes the damper 6 to be brought into contact with the vibrating string 4. Thus, the motion controller 11 determines the reference backward key trajectories for the black and white keys 1*c*/1*d* to be released.

The servo controller 12 forms servo control loops together with the solenoid-operated key actuators 15 and built-in plunger velocity sensors 15*c*, and achieves the servo control for each of the black and white keys 1*c*/1*d* to be moved. When the time to start a black key 1*c* or white key 1*d* comes, the motion controller 11 supplies the first value of target key position to the servo controller 12, and the serve controller 12 adjusts the driving pulse signal S2 to an appropriate value of the duty ratio. The servo controller 12 starts to supply the driving pulse signal S2 to the solenoid-operated key actuator 15 associated with the black key 1*c* or white key 1*d* to be moved. The driving pulse signal S2 makes the solenoid 15*a* to create the magnetic field around the plunger 15 so that the plunger 15*b* starts upwardly to project from the solenoid 15*a*. The built-in plunger velocity sensor 15*c* determines the plunger velocity, and supplies the plunger velocity signal S3 to the servo controller 12.

The motion controller 11 periodically supplies the values of target key position to the servo controller 12, and the built-in plunger sensor 15*c* reports the current plunger velocity to the servo controller 12. The servo controller 12 calculates a value of target key velocity on the basis of the values of target key position and a value of current key position on the basis of the values of current plunger velocity. The servo controller 12 determines a difference between the value of target key position and the value of current plunger position and a difference between the value of target key velocity and the value of current plunger velocity. When the differences are determined, the servo controller 12 calculates a new value of duty ratio so as to make the differences minimized. The servo controller 12 adjusts the driving pulse signal S2 to the new value of duty ratio. The above-described jobs are periodically repeated so that the motion controller 11 and servo controller 12 force the black key 1*c* or white key 1*d* to pass through the reference point at the reference forward key velocity.

When the note-off event data code reaches the motion controller 11, the motion controller 11 determines the reference backward key trajectory, and starts to control the solenoid-operated key actuator 15 in cooperation with the servo controller 12.

It is possible to control sixteen channels by using MIDI music data codes. Accordingly, sixteen tracks Tr0 to Tr15 are available for the automatic playing and automatic accompaniment. In this instance, the track Tr1 and track Tr15 are respectively assigned to the MIDI music data codes for an automatic accompaniment and timing control data codes, and are called as an "accompaniment track" and a "cue time track", respectively.

The pieces of timing control data codes make the automatic accompanist properly proceed with the accompaniment for the fingering on the keyboard 1*a*. Word "cue note" is defined as "a particular quasi-key event" equivalent to a key event to be occurred in the melody performed by the player", and is stored in a cue note data code. Word "cue time" is defined as the duration or lapse of time between a cue note and the next cue note, and is stored in a cue time data code. The cue note data codes and cue time data codes are stored in the cue time track Tr15. Since the cue note data codes are not transferred to the electronic tone generator 13, any electronic tone is not produced on the basis of the cue note data code. The automatic accompanist plays the accompaniment on the basis of the key event data codes read out from the accompaniment track Tr1. For this reason, the event expressed at the depressed key 1*c*/1*d* is called as "quasi-key event".

In order to make another musical instrument, in which the automatic accompaniment subroutine program is not installed, play the accompaniment on the basis of the MIDI music data codes in the accompaniment track Tr1, manufacturers give a header different from that of the accompaniment track Tr1 to the cue time track Tr15. For this reason, the musical instrument does not produce any tone on the basis of the cue note data codes.

Figure 5:
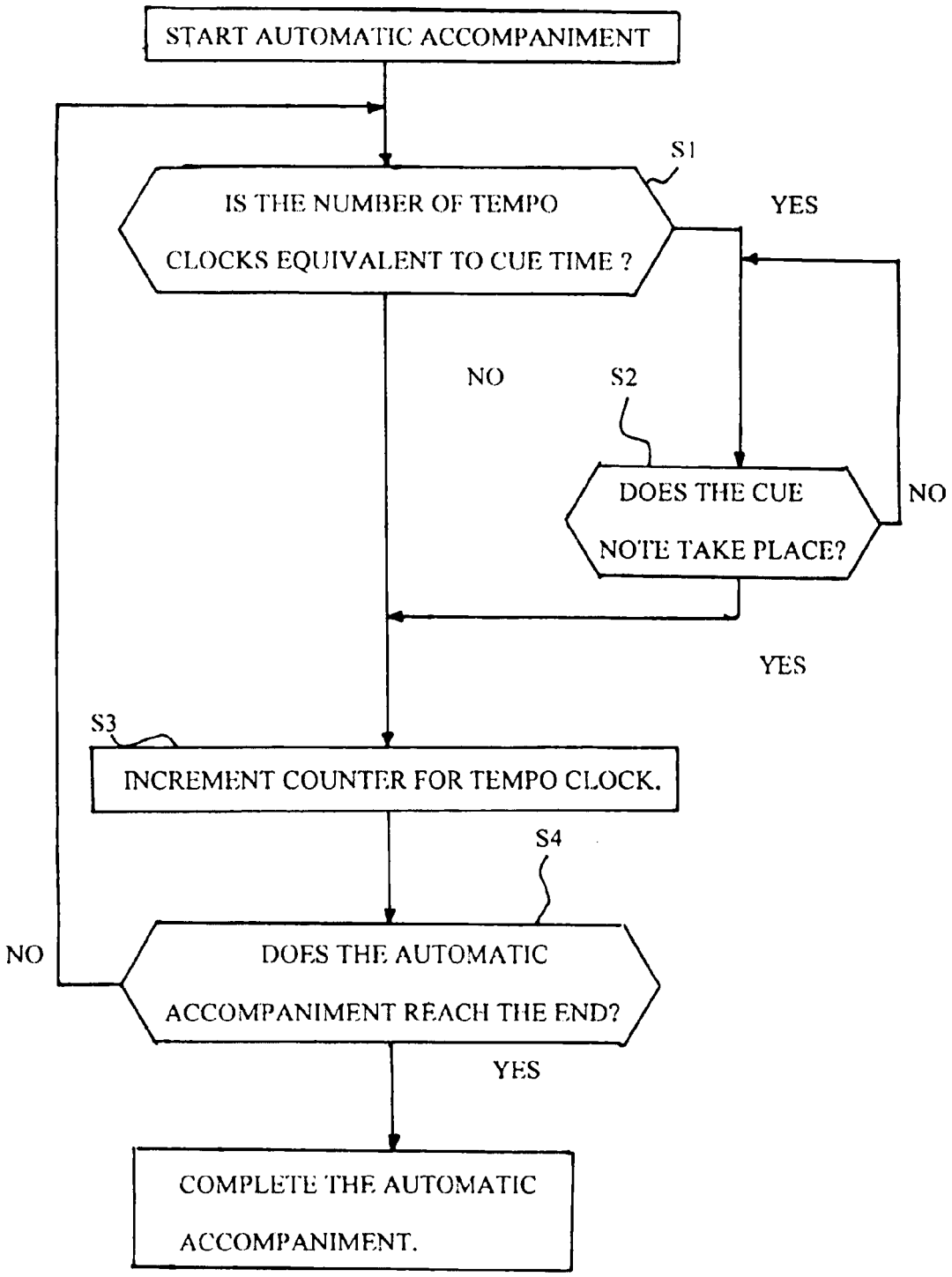
FIG. 5 is a flowchart showing a control sequence for measuring a cue time.

The automatic accompanist measures the duration by counting the tempo clocks. FIG. 5 shows a control sequence for the cue notes. When a human player instructs the automatic accompanist to accompany his or her performance along a melody with the electronic tones, the main routine program starts periodically branch to the automatic accompany subroutine program. The control sequence shown in FIG. 5 forms a part of the automatic accompany subroutine program. A counter, which forms a part of the information processor 10, is assigned to the measurement of tempo clocks.

The central processing unit checks the counter to see whether or not the number of tempo clocks becomes equivalent to the first cue time as by step S1. While the number of tempo clocks is being indicative of the lapse of time shorter than the first cue time, the answer at step S1 is given negative "No", and the central processing unit increments the counter as by step S3.

After the increment of counter, the central processing unit checks the accompaniment track Tr15 to see whether or not the accompaniment is completed as by step S4. While the accompaniment is proceeding toward the end, the answer is given negative "No", and the central processing unit returns to step S1. Thus, the central processing unit reiterates the loop consisting of steps S1, S3 and S4 until the first cue time is expired.

When the first cue time is expired, the number of tempo clocks becomes equivalent to the first cue time, and the answer at step S1 is changed to affirmative "Yes". With the positive answer, the central processing unit proceeds to step S2. The central processing unit checks the register assigned to the black key 1*c* or white key 1*d* for the cue note to see whether or not the human player depresses the key 1*c*/1*d*. In other words, the central processing unit checks the register to see whether or not the note-on event for the cue note takes place as by step S2. While the fingering for the melody is being retarded, the player fingers a part of melody before the cue note, and the note-on event at the cue note has not been taken place. Then, the answer at step S2 is given negative "No". With the negative answer, the central processing unit raises the cue note flag, and periodically repeats step S2. Thus, the non-occurred cue note interrupts the accompaniment. While the cue flag is being raised, the counter for the accompaniment track Tr1 is not incremented. In other words, the non-occurred cue note makes the automatic accompanist wait for the depressed key 1*c*/1*d* at the cue note.

When the player depresses the black key 1*c* or white key 1*d* for the cue note, the answer at step S2 is changed to affirmative "Yes", and the central processing unit takes down the cue flag. Then, the central processing unit reads out the next cue time, and restarts the measurement of lapse of time for the next cue note. Thus, the central processing unit reiterates the loop consisting of steps S1 to S4 so as to make the accompaniment synchronized with the performance along the melody.

The central processing unit sequentially reads out the duration data codes and MIDI music data codes from the accompaniment track Tr1 in parallel to the execution along the control sequence shown in FIG. 5. When the each duration, which is read out from the accompaniment track Tr1, is expired, the central processing unit transfers the MIDI music data code or codes expressing the key event or events to the electronic tone generator 13 in so far as the cue flag is not raised. However, the raised cue flag does not permit the central processing unit to increment the counter for the duration data code read out from the accompaniment track Tr1. In other words, while the cue flag is being raised, the electronic tone is not produced. In this situation, when the cue flag is taken down, the central processing unit restarts the measurement of lapse of time. Upon expiry of the time period expressed by the duration data code, the central processing unit transfers the MIDI music data code or codes to the electronic tone generator 13, and starts the measurement of the lapse of time to the next key event.

When the central processing unit executes the last MIDI music data code in the accompaniment track Tr1, or when the player instructs the automatic accompanist to end the accompaniment, the answer at step S4 is changed to affirmative "Yes", and the central processing unit returns to the main routine program.

Figure 6:
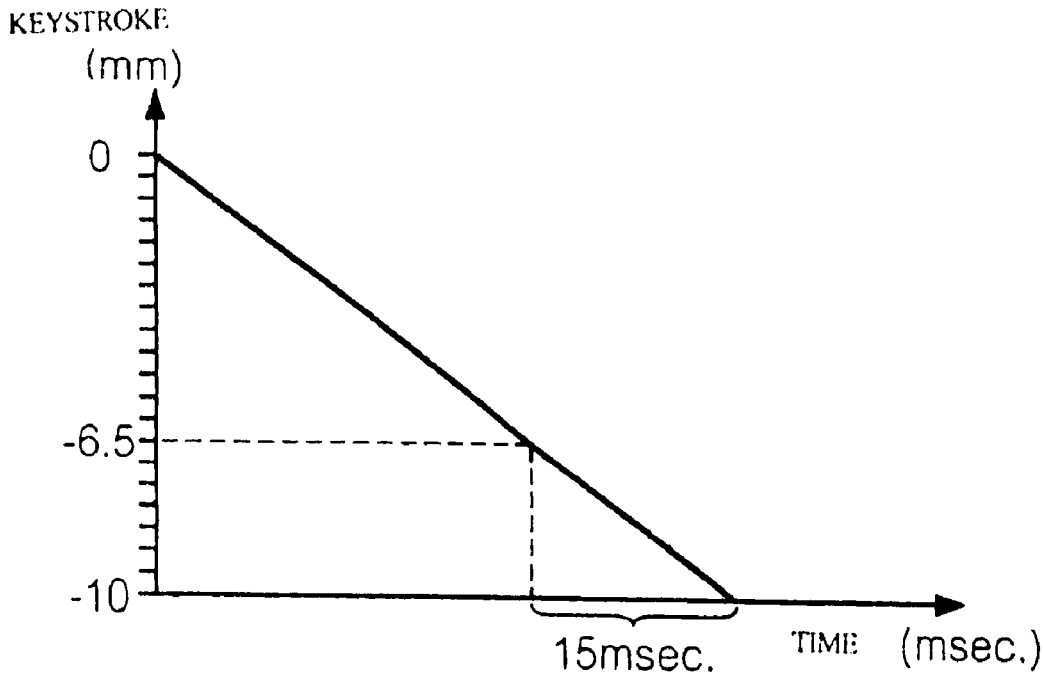
FIG. 6 is a graph showing a relation between the keystroke and time.

The automatic accompanist produces the tones of accompaniment at proper timing for the acoustic piano tones in the melody as follows. FIG. 6 shows the keystroke of a black key 1*c* or white key 1*d* varied with time. While the key 1*c*/1*d* is staying at the rest position, the keystroke is zero. When the key 1*c*/1*d* reaches the deepest position, the keystroke is −10 millimeters. While the automatic accompanist is accompanying the fingering of player with the electronic tones, the central processing unit transfers the key event data codes to the electronic tone generator 13 at the arrival of the corresponding keys 1*c*/1*d* at the deepest points, i.e., at the timing that the keystroke becomes −10 millimeters, and the electronic tones are immediately produced. However, the central processing unit transfers the key event data code or codes to the electronic tone generator 13 before reaching −10 millimeters for the electronic tones after the interruption.

In detail, the cue time is assumed to be expired without the cue note. The central processing unit raises the cue flag, and interrupts the transfer of key event data code to the electronic tone generator 13. In this situation, if the central processing unit transfers the key event data code to the electronic tone generator 13 slightly before reaching the deepest point. When the depressed key 1*c*/1*d* passes through the key position equivalent to the keystroke of −6.5 millimeters, the central processing unit releases the key event data code from the interruption of transfer to the electronic tone generator 13. The transmit at −6.5 millimeter is 15 millisecond earlier than the time at which the depressed key 1*c*/1*d* reaches the deepest point.

Subsequently, description is made on an example of the automatic accompaniment with reference to FIGS. 7A to 7C. FIGS. 7A and 7B show the event data codes and duration data codes, which are stored in the accompaniment track Tr1 of a certain music data file. The value of duration data codes are referred to as "delta time" in FIGS. 7A and 7B. Time runs from the first row of FIG. 7A to the last row of the same figure, and the last row of FIG. 7A is followed by the first row of FIG. 7B. FIG. 7C shows the cue data codes and cue time codes, which are stored in the cue time track Tr15 of the same certain music data file.

Figure 8:
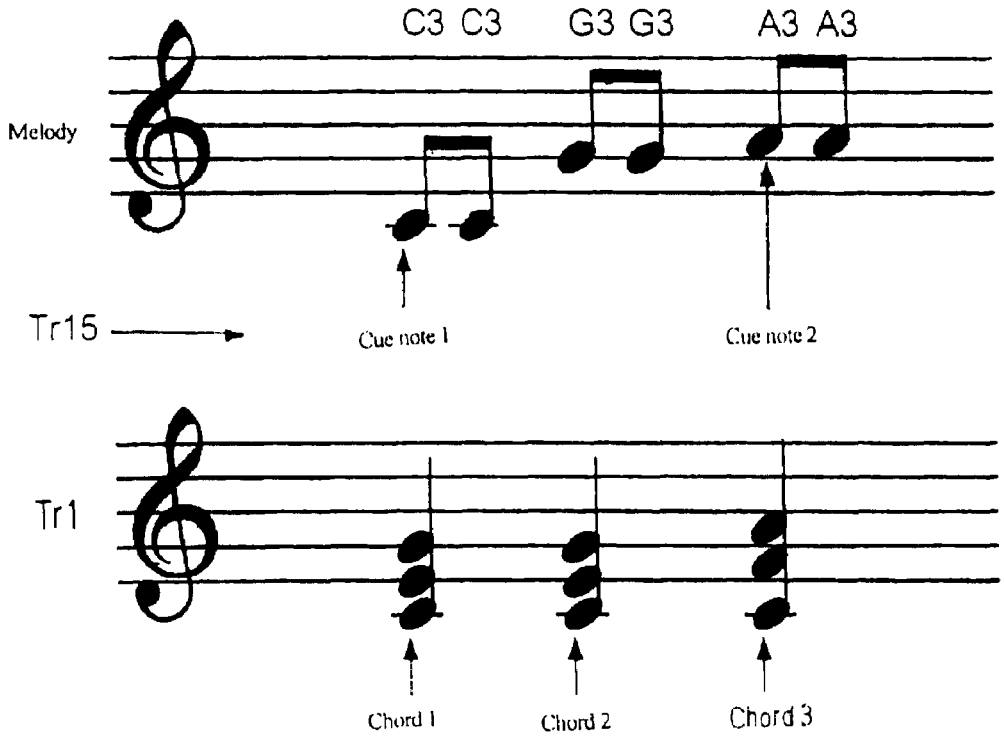
FIG. 8 is a view showing a part of a score for a melody and another part of the score for an accompaniment.

FIG. 8 shows parts of score for the melody and accompaniment, and notes in the upper staff notation and notes in lower staff notation are respectively indicative of the tones along the melody and the chords for the accompaniment. The first note "C" and fifth note "A" are specified as the first cue note "cue note 1" and the second cue note "cue note 2". The human player performs the melody, and the automatic accompanist performs the chords. The key events for the chords are stored in the accompaniment track Tr1, and the cue note "cue note 1", "cue note 2", . . . are stored in the cue time track Tr1.

The note "C3" and note "A3" are corresponding to the key number 60 and key number 69, respectively, so that "60" and "69" are written in the cue time track Tr1. (See the second row and fourth row in FIG. 7C.) The piece of music is to be performed at the tempo of 120 so that the quarter note is equivalent to the number of tempo clocks of 480. The time period from the initiation of performance to the cue note 1 is zero, and, accordingly, the cue time in the first row is zero. The time period between the cue note 1 and the next cue note 2 is equivalent to two quarter notes so that the cue time in the third row is 960.

The first chord, i.e., Chord 1 is to be produced concurrently with the first note "C3" so that the duration data codes in the first, third and fifth rows are "0" as shown in FIG. 7A. The note-on event data codes for the tones of Chord 1 are found in the second, fourth and sixth rows. Chord 1 is constituted by three tones "C3", "E3" and "G3", and accordingly, the key numbers "60", "64" and "67" are written in the second, fourth and sixth rows. The three tones of Chord 1 are quarter notes, and Chord 2 follows Chord 1 without any rest. For this reason, the duration in the seventh row is equivalent to 480 tempo clocks. After the lapse of time equivalent to 480 tempo clocks, Chord 1 is to be decayed, and Chord 2 is to be produced. The note-off event data codes are written in the eighth, tenth and twelfth rows, and the key-on event codes are found in the fourteenth, sixteenth and eighteenth rows. The tones of Chord 1 are to be concurrently decayed, and the tones of Chord 2 are to be concurrently produced. For this reason, the duration "0" is written in the ninth, eleventh, thirteenth, fifteenth, seventeenth and nineteenth rows. The duration data codes and key event data codes after the nineteenth row are determined as similar to the previous duration data codes and previous key event data codes.

The performance proceeds as follows. In order to make the two counters distinguishable from one another, the counter for the accompaniment track Tr1 and the other counter for the cue time track Tr15 are respectively referred to as "duration counter" and "cue time counter", respectively. The central processing unit increments the cue time counter before the duration counter is incremented.

First, a human player inserts a compact disk, in which a music data file containing the tracks shown in FIGS. 7A to 7C is stored, on the tray of the disk driver 120, and instructs the automatic accompanist to accompany his or her performance with the electronic tones. Then, the music data file is read out from the compact disk, and is stored in the random access memory of the information processor 10.

The central processing unit periodically fetches the pieces of key position data from the interface assigned to the key position sensors 14, and accumulates the new pieces of key position data in the registers assigned to the black keys 1*c* and white key 1*d*. The central processing unit checks the registers to see whether or not any key is moved from the previous routine.

The central processing unit reads out the duration data code and cur time code from the accompaniment track Tr1 and cue time track Tr15, respectively, and checks the cue time counter and duration counter to see whether or not any one of the counters reaches the number of tempo clocks equivalent to the read-out codes. The central processing unit periodically increments the cue time counter and duration counter with the tempo clocks. The central processing unit increments the cue time counter before the duration counter is incremented.

The first cue time data code is indicative of the lapse of time "0" as written in the first row in FIG. 7C so that the central processing unit finds the cue time expired before incrementing the cue time counter. Then, the central processing unit raises the cue flag, and immediately interrupts the duration counter. The central processing unit periodically checks the register assigned to the white key 1*d* at "C3", the central processing unit waits for the initiation of performance.

The human player starts the performance. The white key 1*d* is depressed, and passes through the key position equivalent to the keystroke of −6.5 millimeters. Then, the central processing unit takes the cue flag down, and the duration of "0" is expired concurrently with the transit through the key position. Then, the central processing unit transfers the note-on event data codes for the notes "C3", "E3" and "G3" from the accompaniment track Tr1 in the random access memory to the electronic tone generator 13. The above-described data processing and data transfer consume ten-odd milliseconds. Since the central processing unit starts the data processing 15 milliseconds before reaching the deepest key position, the electronic tones of Chord 1 are produced around the arrival of white key 1*d* at the deepest key position. Thus, the automatic accompanist makes the human player feet the chords timely produced.

After the transfer of the key event data codes to the electronic tone generator 13, the central processing unit reads out the duration data code of "480" from the accompaniment track Tr1, and restarts the duration counter. The central processing unit further reads out the cue time data code of "960" from the cue time track Tr15, and restarts the cue time counter. The central processing unit periodically increments the duration counter and cue time counter, and checks those counters to see whether or not at least one of those counters reaches the number of tempo clocks equivalent to "480" or "960". While the answer is being given negative, the central processing unit continues to increment both counters, and compares the counters with "480" and "960".

The duration counter reaches "480" before the cue time counter reaches "960". The cue flag is not raised. When the duration counter reaches "480", 0.5 second is expired, and the central processing unit transfers the note-off event data codes for Chord 1 and note-on event data codes for Chord 2 from the accompaniment track Tr1 to the electronic tone generator 13. The electronic tones "C3", "E3" and "G3" of Chord 1 are decayed, and the electronic tones "C3", "E3" and "G3" are produced for Chord 2. The central processing unit reads out the next duration data code expressing the tempo clocks "480" equivalent to 0.5 second, and resets the duration counter to zero. The central processing unit periodically increments the duration counter and cue time counter.

If the human player properly fingers on the keyboard 1*a*, the human player depresses the white key for "A3" immediately before the cue time counter reaches "960", and the central processing unit keeps the cue flag lowered. The duration counter reaches "480" without any interruption. As a result, the key event data codes are transferred from the accompaniment track Tr1 to the electronic tone generator 13, and the electronic tones of Chord 3 are timely produced.

However, the human player may keep the white key 1*d* for the second tone "G3" depressed over 0.25 second such as for 0.4 second. The second electronic tone "G3" is prolonged, and the movement of white key for "A3" is delayed. In this situation, the cue time counter reaches "960" before the human player depresses the white key 1*d* for "A3" so that the central processing unit raises the cue flag. As a result, the central processing unit stops the duration counter immediately before reaching "480". The central processing unit periodically checks the register assigned to the white key 1*d* for "A3" to see whether or not the human player passes the white key 1*d* for "A3" through the key position equivalent to the keystroke of −6.5 millimeters. While the answer is being given negative, the central processing unit keeps the cue flag raised so that the duration counter does not reach "480". When the white key 1*d* for "A3" passes through the key position equivalent to the keystroke −6.5 millimeters, the answer is changed to affirmative, and the central processing unit takes the cue flag down. Accordingly, the central processing unit permits the duration counter to reach "480". When the duration counter reaches "480", the central processing unit transfers the note-off event data codes for "C2", "E3" and "G3" of Chord 2 and the note-on event data codes for "C3", "F3" and "A3" of Chord 3 from the accompaniment track Tr1 to the electronic tone generator 13. As a result, the electronic tones "C3", "E3" and "G3" of Chord 2 are decayed, and the electronic tones "C3", "F3" and "A3" of Chord 3 are produced. Since the central processing unit enters the above-described data processing at the key position equivalent to the keystroke of −6.5 milliseconds, the electronic tones "C3", "F3" and "A3" are timely produced in spite of the above-described data processing, and the human player feels the accompaniment well synchronous with the melody.

As will be appreciated from the foregoing description, the cue time data codes and cue note data codes are processed in parallel to the data processing on the duration data codes and key event data codes, and interrupts the count-up in the duration counter after the cue flag counter reaches the target number of tempo clocks without any report that the cue note takes place. As a result, the progress of accompaniment is delayed, and the tones are timely produced for the accompaniment.

In this instance, the cue note data codes and cue time data codes are stored in the cue time track Tr15 separately from the duration data codes and key event data codes in the accompaniment track Tr1, and the control codes in the header of cue time track Tr15 is made different from that in the header of accompaniment track Tr1. This feature is desirable, because the music data file is shareable with another musical instrument in which the automatic accompaniment subroutine program is not installed.

Moreover, the cue note is detected at the key position before the key position where the note-on events usually take place. This feature is desirable, because the time margin makes the delay time due to the data processing after the detection of cue note cancelled.

The first note of the melody is specified as the first cue note. This feature is desirable, because the automatic accompaniment automatically starts after the detection of the first cue note.

Second Embodiment

Another automatic player piano embodying the present invention is similar in construction to the automatic player piano shown in FIGS. 1 and 2, and an automatic accompanying subroutine program of the second embodiment is partially different from the automatic accompanying subroutine program described in conjunction with the first embodiment. For this reason, description is focused on the automatic accompanying subroutine program. In the following description, component parts of the automatic player piano are accompanied with references designating the corresponding component parts of the first embodiment, and a key position at which the automatic accompanist admits a cue note is referred to as a "cue note-on key position."

In the first embodiment, the cue notes are detected at the cue note-on key position equivalent to the keystroke of −6.5 millimeters. The cue note-on key position is variable depending upon the key velocity in the second embodiment.

Figure 9A:
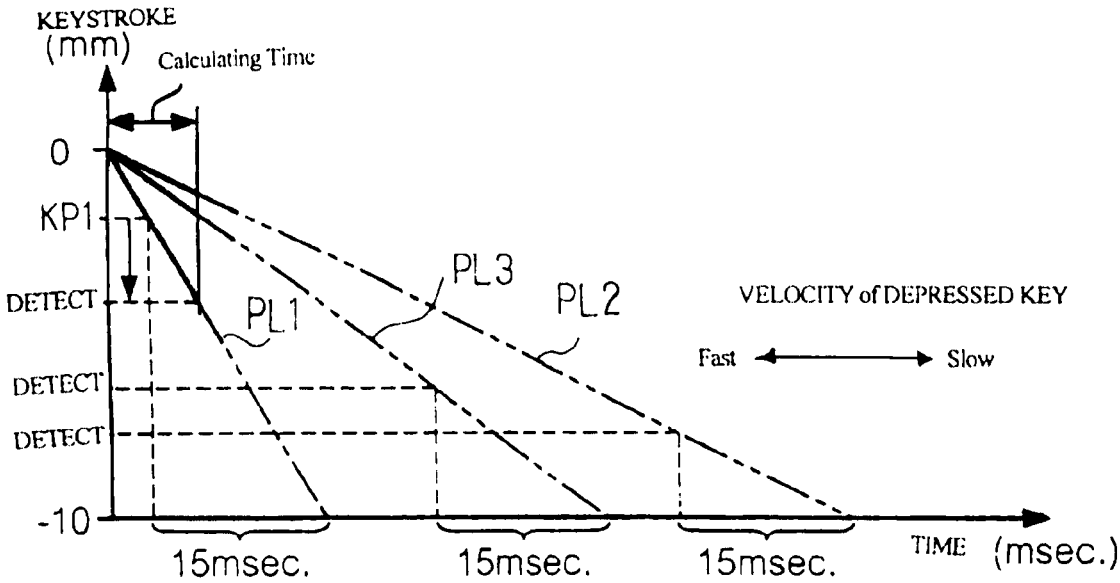
FIG. 9A is a graph showing key positions at which cue notes are detected in another automatic player piano of the present invention.

FIG. 9A shows loci of depressed keys 1*c*/1*d* moved toward the end positions at different values of key velocity. Plots PL1, PL2 and PL3 are indicative of a locus of key 1*c*/1*d* strongly depressed, a locus of key 1*c*/1*d* gently depressed and a locus of key 1*c*/1*d* applied with intermediate force. The key 1*c*/1*d* is moved along the locus expressed by plots PL1 at an extremely large value of key velocity, and the key 1*c*/1*d* is moved along the locus expressed by plots PL2 at a small value of key velocity. The key 1*c*/1*d* is moved along the locus expressed by plots PL3 at an intermediate value of key velocity.

The loci are divided into two parts. The first region is drawn by a real line. While the key 1*c*/1*d* is moving in the first region, the central processing unit completes the calculation for determining the key velocity. The time period consumed for the calculation is depending upon the capability of central processing unit in the information processor 10. In this instance, the time period is of the order of 10 milliseconds. When the key velocity is determined, it is possible to forecast the time at which the key 1*c*/1*d* reaches the deepest key position. The automatic accompanist can determine the cue note-on key position 15 milliseconds before reaching the deepest key position, and "DETECT" is indicative of the cue note-on key position in FIG. 9A.

The cue note-on key position is usually specified in the second region drawn by dots-and-dash lines, and is 15 milliseconds before reaching the deepest key position. However, the key 1*c*/1*d* may pass through the key position in the first region 15 milliseconds before reaching the deepest key position. For example, when the key 1*c*/1*d* is strongly depressed along the loci expressed by plots PL1, the key 1*c*/1*d* passes the key position KP1 15 milliseconds before reaching the deepest key position. In this situation, the automatic accompanist determines the cue note-on key position at the boundary between the first region and the second region.

The depressed key 1*c*/1*d* usually reaches a key position equivalent to the keystroke equal to or less than 2 millimeters from the rest position, and the cue note-on key position is spaced from the key position equivalent to the keystroke. Although the cue note-on key position is determined for the extremely high speed key 1*c*/1*d* at the boundary between the first region and the second region in the second embodiment, the cue note-on key position may be specified at the key position equivalent to the keystroke of −2 millimieters for the extremely high speed key 1*c*/1*d* so as to admit the cue note immediately after the completion of the calculation.

Figure 9B:
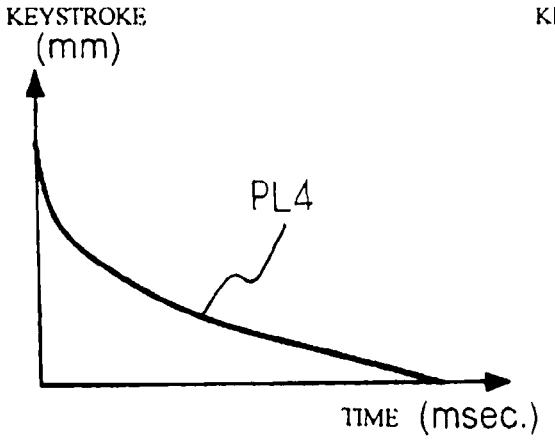
FIGS. 9B and 9C are graphs showing non-linear loci of depressed keys.
Figure 9C:
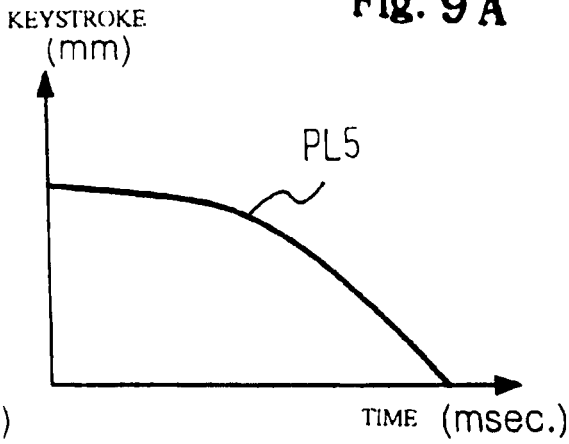
Figure 1:
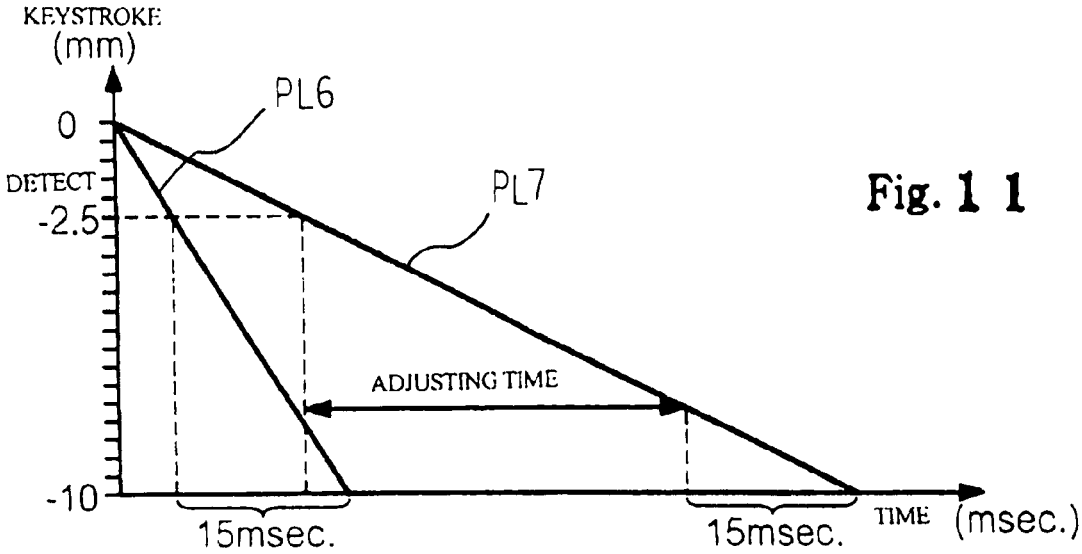

The loci of depressed keys 1*c*/1*d* may be expressed by non-linear lines such as, for example, PL4 and PL5 shown in FIGS. 9B and 9C. In this instance, the central processing unit forecasts the locus of key 1*c*/1*d* on the basis of the pieces of key position data stored in the register. The non-linear loci may be stored in the read only memory of the information processor 10 together with the linear locus. In this instance, the central processing unit compares the pieces of key position data with the corresponding key positions on the linear locus and the corresponding key positions on the non-linear loci to see what loci is the closest. When one of the loci is selected, the central processing unit forecasts the time at which the key 1*c*/1*d* reaches the deepest key position and the cue note-on key position.

Description is hereinafter made on an automatic accompanying subroutine program employed in the second embodiment with reference to FIGS. 10A, 10B and 10C. The subroutine program shown in FIGS. 10A and 10B forms a part of the automatic accompanying subroutine program, and the remaining part of automatic accompanying subroutine program periodically branches to the subroutine program shown in FIGS. 10A and 10B through timer interruptions. The central processing unit executes the instruction codes of the subroutine program shown in FIGS. 10A, 10B and 10C for a predetermined time period, and returns to the remaining portion of automatic accompanying subroutine program.

Figure 10A:
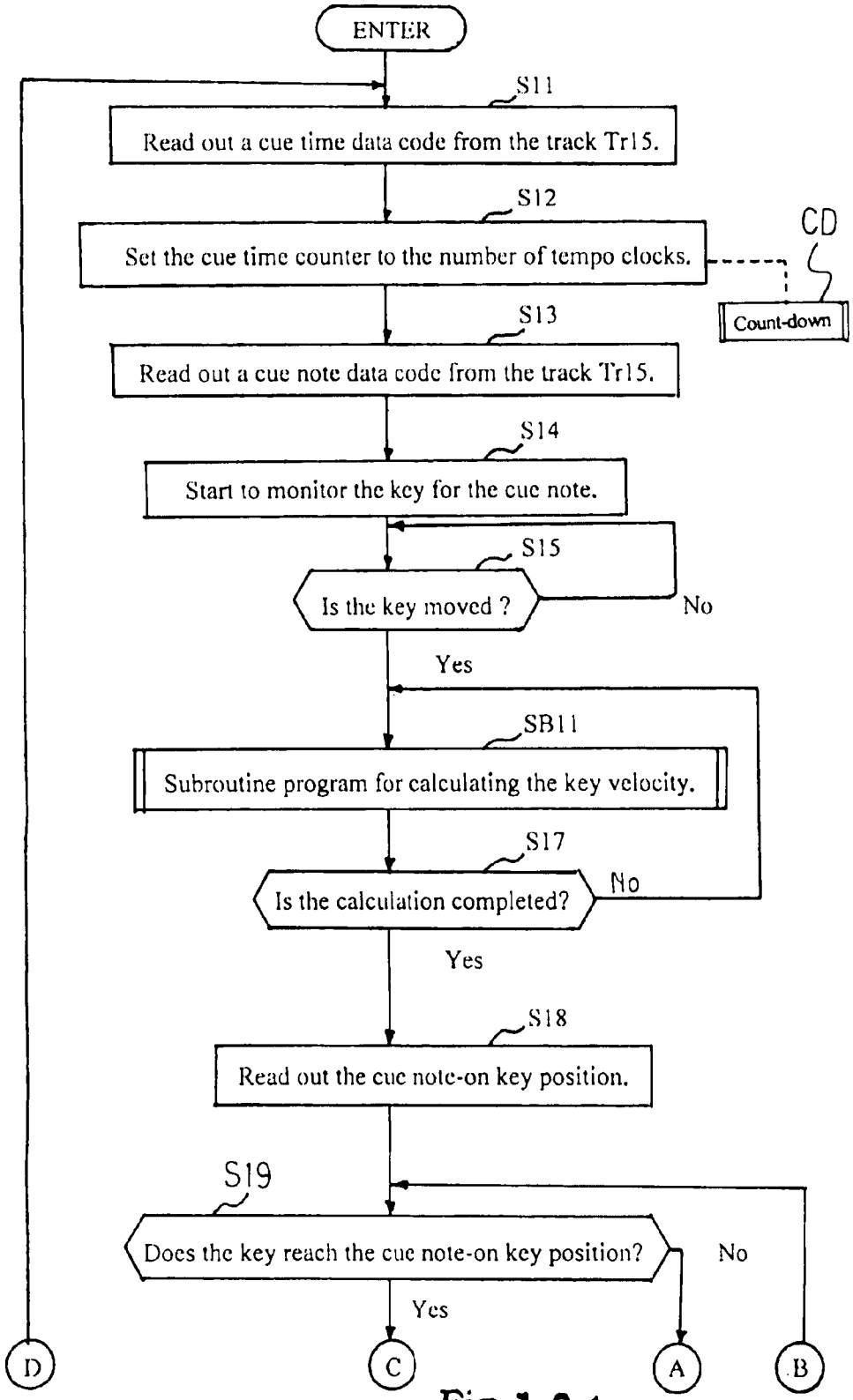
FIGS. 10A and 10B are flowcharts showing a subroutine program for controlling an automatic accompaniment carried out in the automatic player piano.

While the automatic accompanying subroutine program is running on the central processing unit, the automatic accompanying subroutine program further periodically branches to a count-down program through other timer interruptions as indicated by CD in FIG. 10A. The cue time counter and duration counter are decremented with the tempo clocks. When a human player instructs the automatic accompanist to accompany his or her performance with electronic tones, the automatic accompanying subroutine program starts periodically to branch to the subroutine program shown in FIGS. 10A and 10B.

First, the central processing unit reads out the first cue time data code from the cue time track Tr15 as by step S11, and sets the cue time counter to the number of tempo clocks as by step S12. The cue time counter is periodically decremented with the tempo clocks as indicated by CD in so far as the cue flag is not raised.

Subsequently, the central processing unit reads out the cue note data code from the cue time track Tr15 as by step S13, and starts to monitor the key 1*c*/1*d* assigned the key number same as that of the cue note as by step S14.

The central processing unit checks the register assigned to the key 1*c*/1*d* to see whether or not the human player starts to depress the key 1*c*/1*d* as by step S15. While the key 1*c*/1*d* is staying at the rest position, the answer at step S15 is given negative "No", and the central processing unit repeatedly checks the register assigned to the key 1*c*/1*d*.

The human player is assumed to start to depress the key 1*c*/1*d*. The answer at step S15 is changed to affirmative "Yes". With the positive answer "Yes", the central processing unit starts to enter a subroutine program SB11, and the control sequence of subroutine program SB11 is illustrated in FIG. 10C.

Upon entry into the subroutine program SB11, the central processing unit determines the key position and time immediately after the initiation of key movement as by step S31.

Subsequently, the central processing unit checks an internal clock to see whether or not the calculating time is expired as by step S32. While the key 1*c*/1*d* is moving in the first region of the locus, the answer at step S32 is given negative "No" so that the central processing unit returns to the subroutine program shown in FIG. 10A. The central processing unit proceeds to step S17, and checks a register assigned to the cue note-on key position to see whether or not the cue note-on key position has been already stored in the register. In other words, whether or not the calculation is completed as by step S17. While the key 1*c*/1*d* is moving in the first region, it is impossible to calculate the key velocity so that any cue note-on key position has not been stored in the register, yet, and the answer at step S17 is given negative "No". With the negative answer "No", the central processing unit returns to the subroutine program SB11. Thus, the central processing unit repeatedly enters the subroutine program SB11 and returns therefrom until the calculating time is expired.

When the calculating time is expired, the answer at step S32 is changed to affirmative "Yes". With the positive answer "Yes", the central processing unit determines the key position and the time when the key 1*c*/1*d* reaches the boundary between the first region and the second region as by step S33, and, thereafter, stores the key velocity as by step S34.

Subsequently, the central processing unit forecasts a certain time at which the key 1*c*/1*d* will reach the deepest key position, and determines the cue note-on key position at 15 milliseconds before the certain time. The central processing unit stores the cue-note on key position in the working memory as by step S35, and returns to the subroutine program shown in FIG. 10A.

When the central processing unit returns to the subroutine program shown in FIG. 10A, the answer at step S17 is changed to affirmative "Yes". Then, the central processing unit reads out the cue note-on key position from the working memory as by step S18, and compares the newest key position with the cue note-on key position to see whether or not the key 1*c*/1*d* reach the cue note-on key position as by step S19.

While the key 1*c*/1*d* is traveling on the locus before the cue note-on key position, the answer at step S19 is given negative "No". The central processing unit proceeds to step S18, and checks the cue time counter to see whether or not the cue time is expired. If the cue time counter has not reached zero, the answer at step S20 is given negative "No", and the central processing unit returns to step S19. Thus, the central processing unit reiterates the loop consisting of steps S19 and S20 until the key 1*c*/1*d* reaches the cue note-on key position. On the other hand, if the cue time counter has already reached zero before the key 1*c*/1*d* is still on the way to the cue note-on key position, the answer at step S20 is given "affirmative", and the central processing unit acknowledges that the human player delays the fingering. With the positive answer "Yes" at step S20, the central processing unit raises the cue flag as by step S21, and returns to step S19. Thus, the automatic accompanist interrupts the accompaniment.

When the key 1*c*/1*d* passes through the cue note-on key position, the answer at step S19 is given affirmative "Yes", and the central processing unit checks the cue time counter to see whether or not the cue time is expired. There are two theoretical possibilities. The first possibility is that the key 1*c*/1*d* passes through the cue note-on key position after the cue time counter reached zero. (See the path from "yes" at step S20 through step S21 and "yes" at step S19 to "yes" at step S22.) In this situation, the central processing unit takes the cue flag down as by step S23, and permits the key event code or codes to be transferred to the electronic tone generator 13 before proceeding to step S24. The second possibility is that the cue time counter reaches zero after the key 1*c*/1*d* passed through the cue note-on key position. (See the path directly from "yes" at step S19 without execution at steps S20 and S21.) When the human player gives rise to the movement of the key 1*c*/1*d* along the locus expressed by plots PL1 for producing the first cue note in the melody, the cue note-on key position is specified at KP1 in the first region, the central processing unit confirms that the cue flag is still lowered at step S23, and permits the central processing unit immediately transfers the note-on event data codes to the electronic tone generator 13.

On the other hand, when the human player gives rise to the movement of key 1*c*/1*d* on the locus expressed by plots PL1 at the other cue notes, a certain number of tempo clocks is still stored in the cue tome counter, and the answer at step S22 is given negative "No". However, the chord is to be immediately produced. For this reason, the central processing unit permits the key event data codes to be transferred to the electronic tone generator 13, and proceeds to step S24.

The central processing unit checks the cue time track Tr15 to see whether or not any cue note is left in the cue time track Tr15. When the central processing unit finds another cue note and, accordingly, cue time, the central processing unit returns to step S11, and repeats the loop consisting of the step S11 to S24 and subroutine program SB1 for the new cue note and cue time.

Figure 10B:
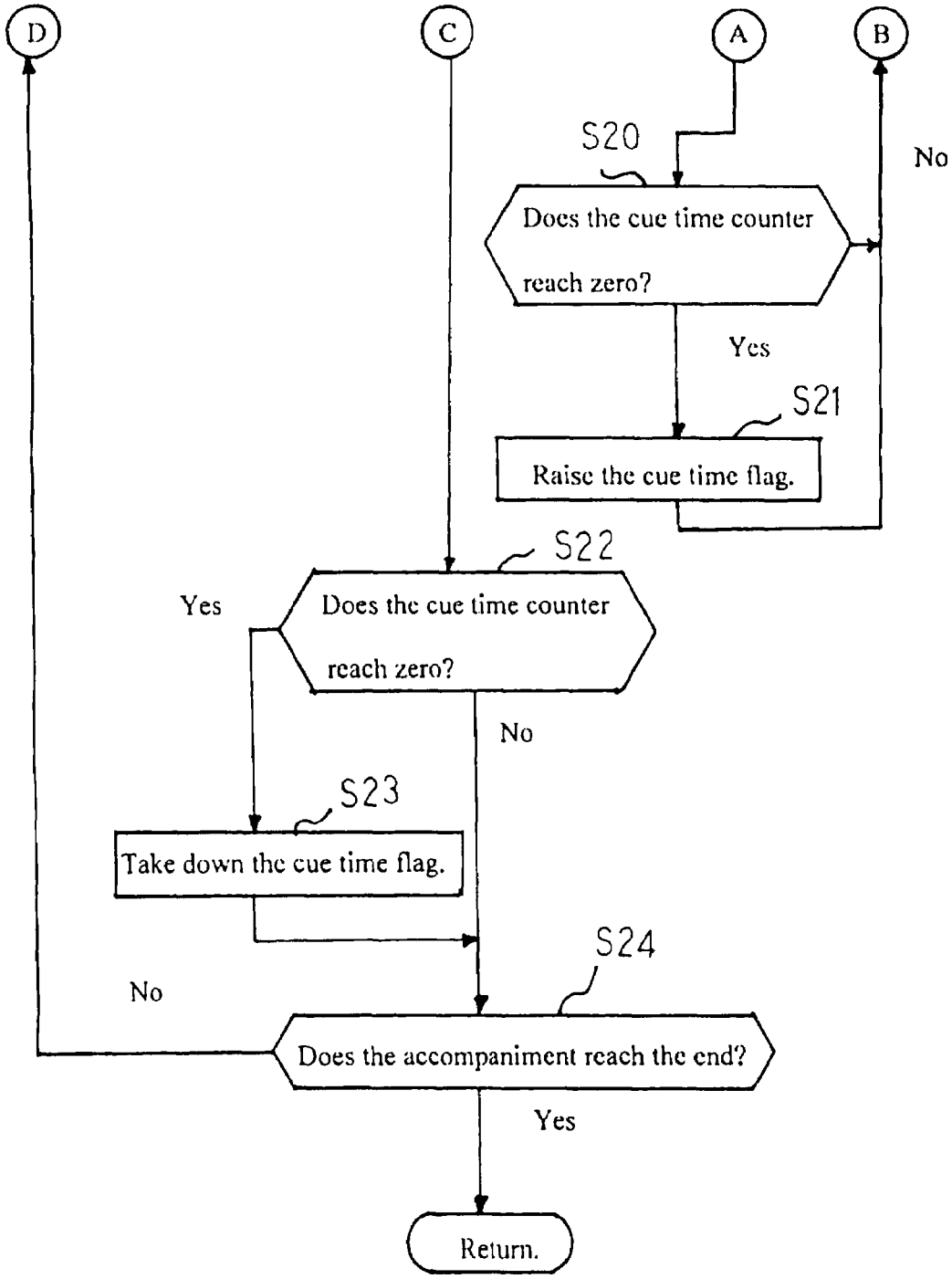
Figure 10C:
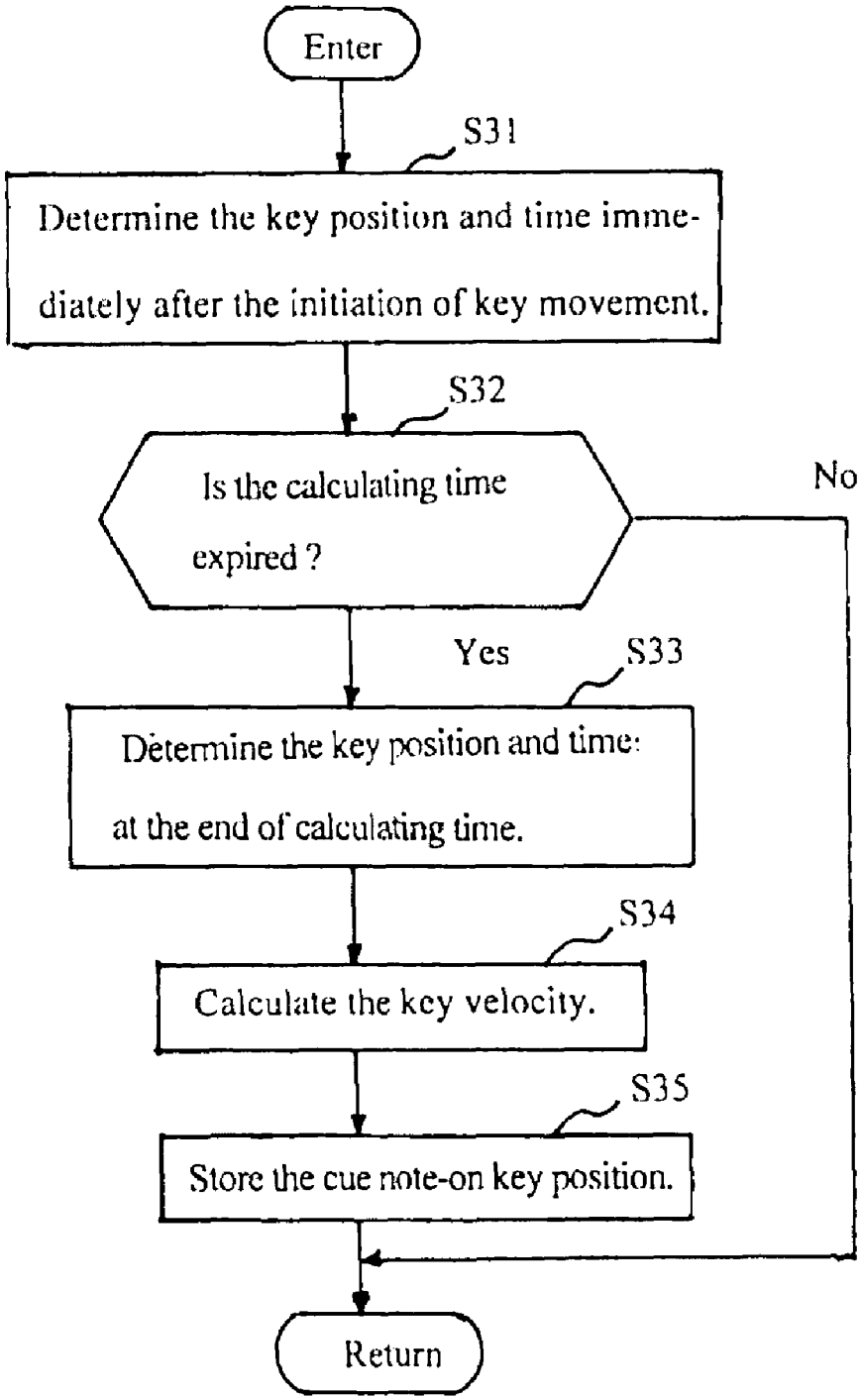
FIG. 10C is a flowchart showing a subroutine program for calculating note-on key position.

On the other hand, if the central processing unit does not find any other cue note, the central processing unit returns to the remaining part of the automatic accompanying subroutine program, and does not enter the subroutine program shown in FIGS. 10A to 10C after the return.

As will be understood from the foregoing description, the automatic accompanist timely produces the tones of accompaniment as similar to that of the first embodiment. Moreover, the cue note-on key position is varied depending upon the velocity of depressed keys. For this reason, the timing to produce the tones of accompaniment is closer to the cue notes than that of the first embodiment.

Third Embodiment

Yet another automatic player piano embodying the present invention is similar in construction to the automatic player piano shown in FIGS. 1 and 2, and an automatic accompanying subroutine program of the second embodiment is partially different from the automatic accompanying subroutine program described in conjunction with the first embodiment. For this reason, description is focused on the automatic accompanying subroutine program. In the following description, component parts of the automatic player piano are accompanied with references designating the corresponding component parts of the first embodiment.

In the above-described second embodiment, the cue note-on key position is variable depending upon the key velocity so as to produce the tones of accompaniment at proper timing to the tones in the melody. In other words, the duration counter restarts immediately after the cue flag is taken down. On the other hand, a cue note-on key position is fixed in the automatic accompanying subroutine program of the third embodiment, and the duration counter restarts after expiry of an adjusting time so as to make the tones of accompaniment at proper timing.

FIG. 11 shows loci of a key 1*c*/1*d*. PL6 expresses a locus of a key 1*c*/1*d* strongly depressed, and plots PL7 expresses another locus of the key 1*c*/1*d* gently depressed. The strongly depressed key 1*c*/1*d* reaches the deepest key position, which is equivalent to the keystroke of −10 millimeters, 15 milliseconds after passing through the key position equivalent to the keystroke of −2.5 millimeters. On the other hand, the gently depressed key 1*c*/1*d* reaches the deepest key position later than the strongly depressed key 1*c*/1*d*. Although the strongly depressed key 1*c*/1*d* consumes 15 millisecond after passing through the key position equivalent to −2.5 millimeters, (adjusting time+15 milliseconds) is required for the gently depressed key 1*c*/1*d*. The adjusting time is varied depending upon the velocity of depressed key 1*c*/1*d*.

Figure 12A:
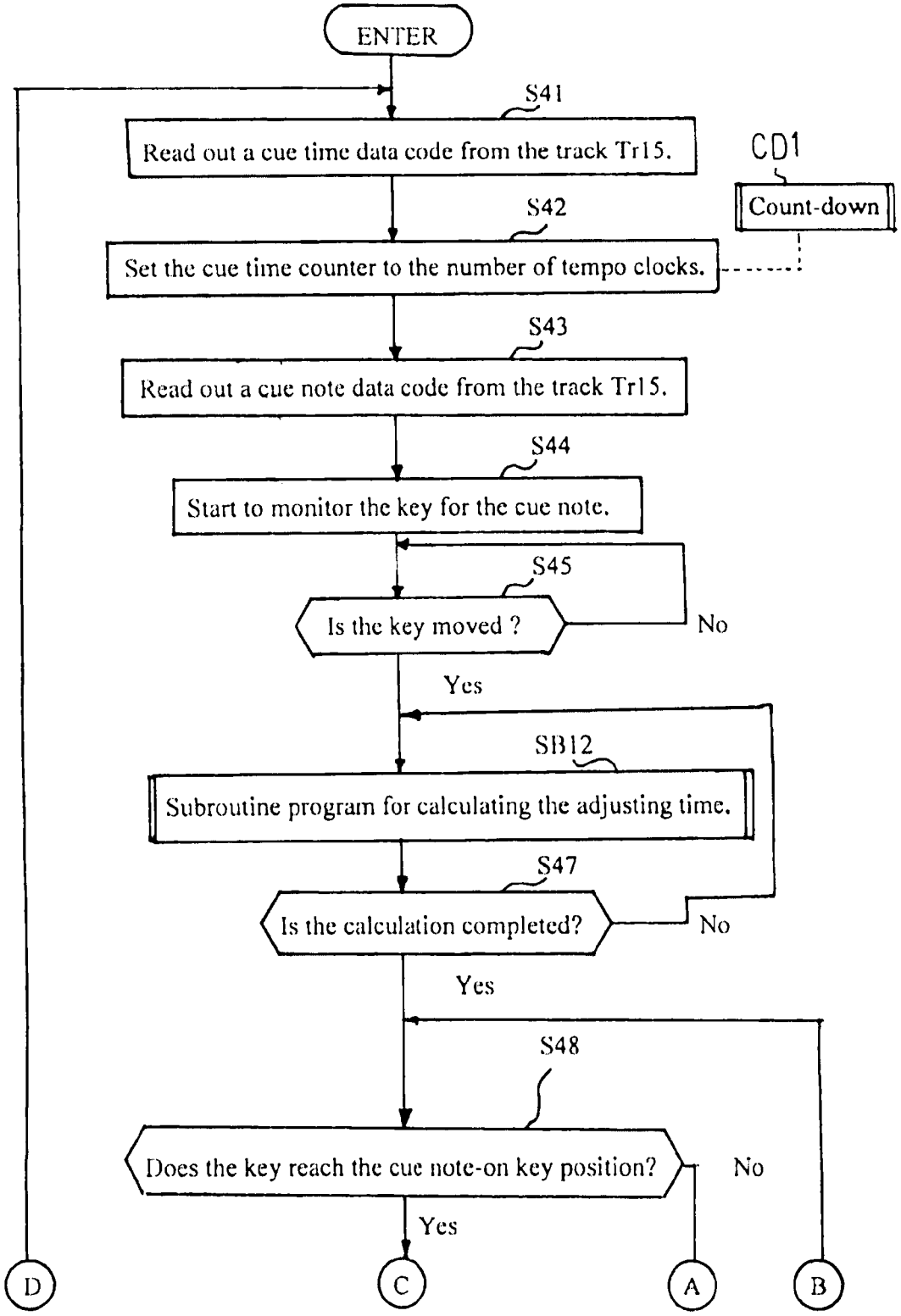
FIGS. 12A and 12B are flowcharts showing a subroutine program for controlling an automatic accompaniment carried out in the automatic player piano.
Figure 12B:
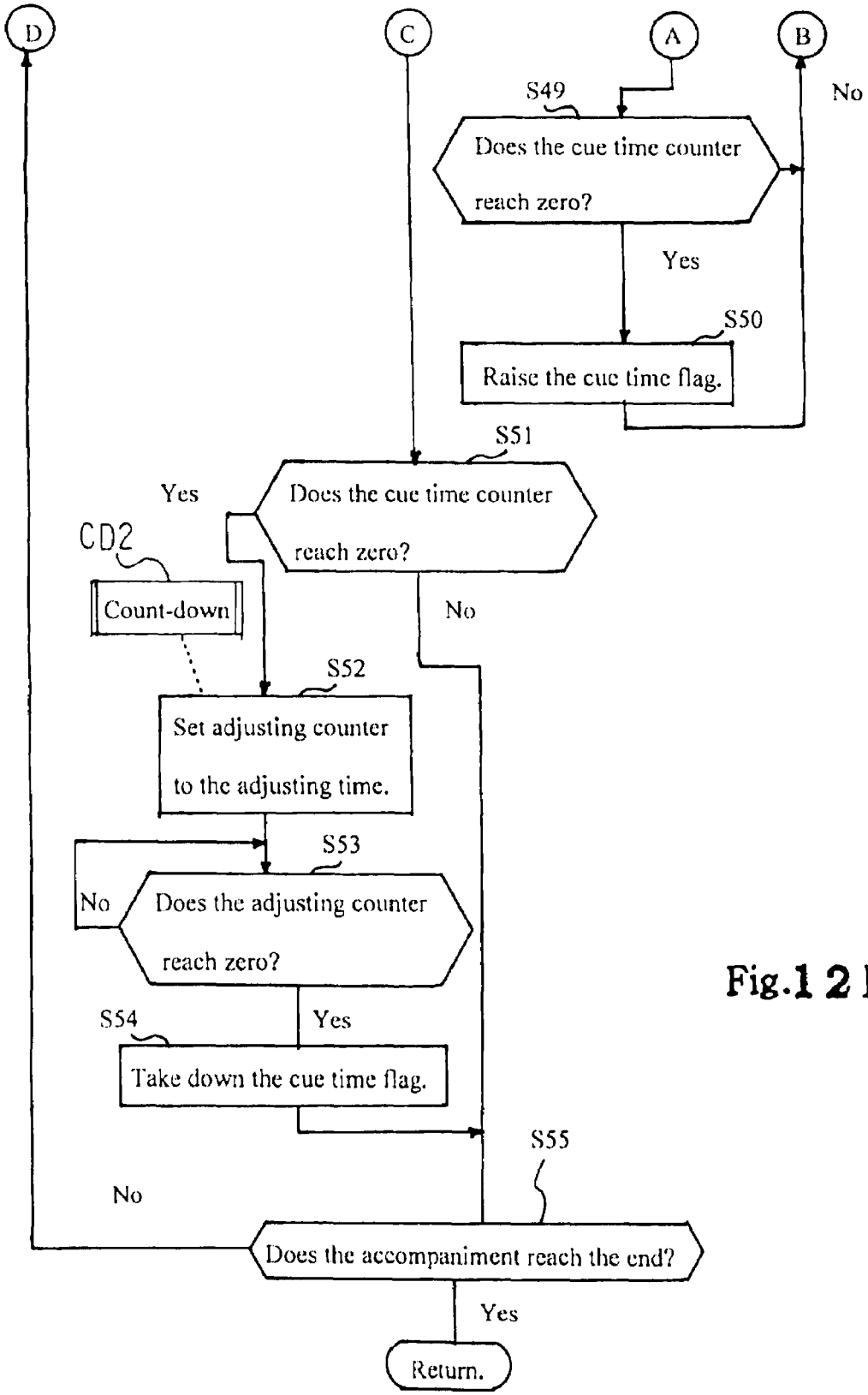
Figure 12C:
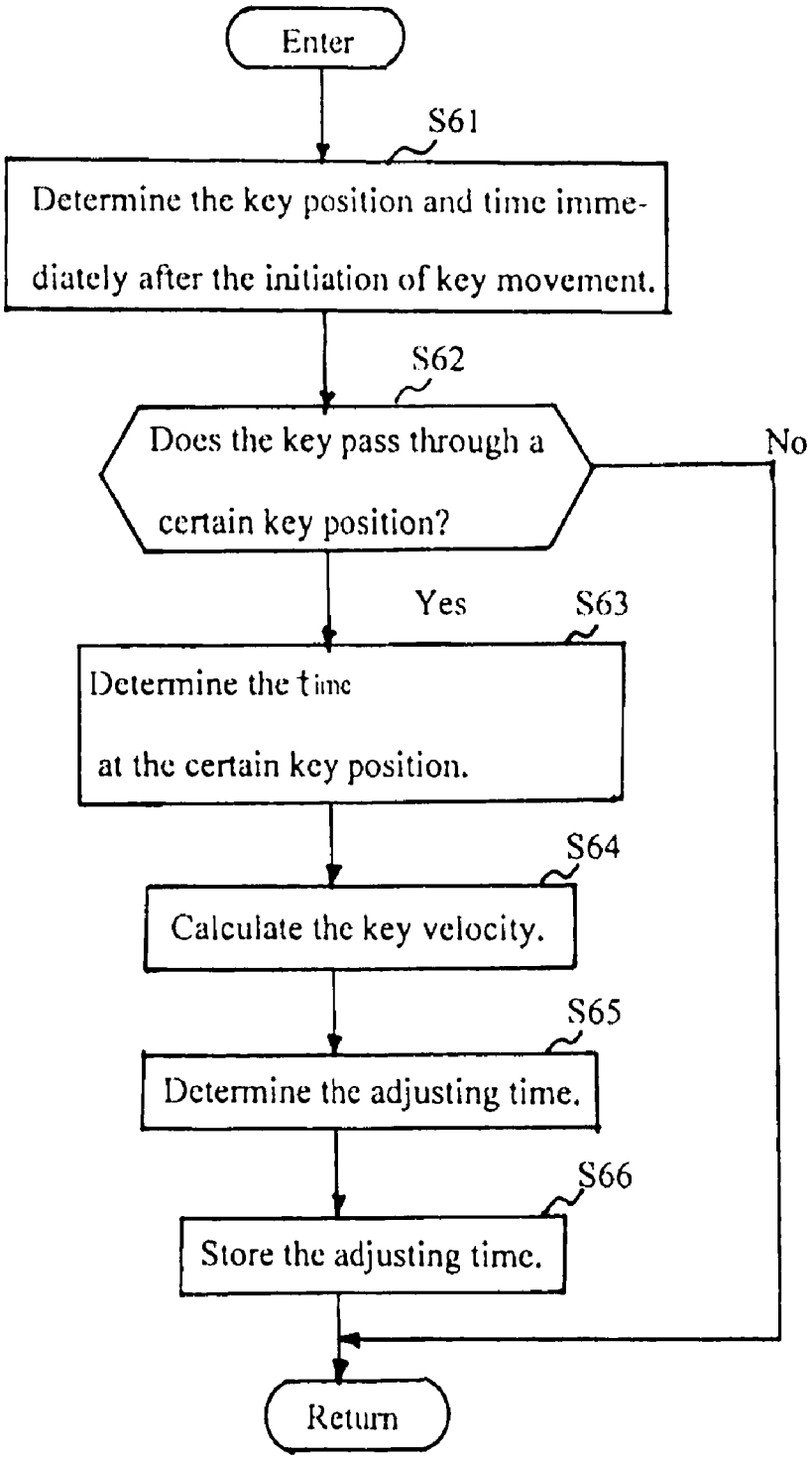
FIG. 12C is a flowchart showing a subroutine program for calculating an adjusting time.

FIGS. 12A, 12B and 12C show a subroutine program forming a part of an automatic accompanying subroutine program installed in the automatic player piano of the third embodiment. A counter is assigned a count-down for the adjusting time, and is referred to as an "adjusting time counter". The plots PL6 stands for the loci of the fastest key 1*c*/1*d*, and the note-on key position is equivalent to −2.5 millimeters from the rest position.

While the automatic accompanying subroutine program is running on the central processing unit, the automatic accompanying subroutine program periodically branches to the subroutine program shown in FIGS. 12A and 12B and further to a count-down program through other timer interruptions as indicated by CD1 in FIG. 12A and CD2 in FIG. 12B. The cue time counter and duration counter are decremented with the tempo clocks in the count-down program CD1, and the adjusting time counter is decremented with the tempo clocks on the condition that the adjusting time counter has been already set to an finite number of tempo clocks.

When a human player instructs the automatic accompanist to accompany his or her performance with electronic tones, the automatic accompanying subroutine program starts periodically to branch to the subroutine program shown in FIGS. 12A and 12B.

First, the central processing unit reads out the first cue time data code from the cue time track Tr15 as by step S41, and sets the cue time counter to the number of tempo clocks as by step S42. The cue time counter is periodically decremented with the tempo clocks as indicated by CD1 in so far as the cue flag is not raised.

Subsequently, the central processing unit reads out the cue note data code from the cue time track Tr15 as by step S43, and starts to monitor the key 1*c*/1*d* assigned the key number same as that of the cue note as by step S44.

The central processing unit checks the register assigned to the key 1*c*/1*d* to see whether or not the human player starts to depress the key 1*c*/1*d* as by step S45. While the key 1*c*/1*d* is staying at the rest position, the answer at step S45 is given negative "No", and the central processing unit repeatedly checks the register assigned to the key 1*c*/1*d*.

The human player is assumed to start to depress the key 1*c*/1*d*. The answer at step S45 is changed to affirmative "Yes". With the positive answer "Yes", the central processing unit starts to enter a subroutine program SB12, and the control sequence of subroutine program SB11 is illustrated in FIG. 12C.

Upon entry into the subroutine program SB12, the central processing unit determines the key position and time immediately after the initiation of key movement as by step S61.

Subsequently, the central processing unit checks an internal clock to see whether or not the key 1*c*/1*d* passes through a certain key position before the key position equivalent to −2.5 millimeters as by step S62. While the key 1*c*/1*d* is moving on the locus before the certain key position, the answer at step S62 is given negative "No" so that the central processing unit returns to the subroutine program shown in FIG. 12A. The central processing unit proceeds to step S47, and checks a register assigned to the adjusting time to see whether or not the adjusting time has been already stored in the register. In other words, whether or not the calculation is completed as by step S47. While the key 1*c*/1*d* is moving on the locus before the certain key position, it is impossible to calculate the adjusting time so that the adjusting time has not been stored in the register, yet, and the answer at step S47 is given negative "No". With the negative answer "No", the central processing unit returns to the subroutine program SB12. Thus, the central processing unit repeatedly enters the subroutine program SB12 and returns therefrom.

When the key passes through the certain key position, the answer at step S62 is changed to affirmative "Yes". With the positive answer "Yes", the central processing unit determines the time when the key 1*c*/1*d* passes through the certain key position as by step S63, and, thereafter, calculates the key velocity as by step S64. As described hereinbefore, the adjusting time is dependent on the key velocity. The central processing unit accesses a table for a relation between the key velocity and the adjusting time, and reads out a value of the adjusting time. Thus, the central processing unit determines the adjusting time as by step S65, and stores the adjusting time in the working memory. The central processing unit returns to the subroutine program shown in FIG. 12A.

When the central processing unit returns to the subroutine program shown in FIG. 12A, the answer at step S47 is changed to affirmative "Yes". Then, the central processing unit reads out the c from the working memory as by step S48, and compares the newest key position with the cue note-on key position to see whether or not the key 1*c*/1*d* reach the cue note-on key position as by step S48.

While the key 1*c*/1*d* is traveling on the locus before the cue note-on key position, the answer at step S48 is given negative "No". The central processing unit proceeds to step S49, and checks the cue time counter to see whether or not the cue time is expired. If the cue time counter has not reached zero, the answer at step S49 is given negative "No", and the central processing unit returns to step S48. Thus, the central processing unit reiterates the loop consisting of steps S48 and S49 until the key 1*c*/1*d* reaches the cue note-on key position. On the other hand, if the cue time counter has already reached zero before the key 1*c*/1*d* is still on the way to the cue note-on key position, the answer at step S49 is given "affirmative", and the central processing unit acknowledges that the human player delays the fingering. With the positive answer "Yes" at step S49, the central processing unit raises the cue flag as by step S50, and returns to step S48. Thus, the automatic accompanist interrupts the accompaniment with the cue flag.

When the key 1*c*/1*d* passes through the cue note-on key position, the answer at step S48 is given affirmative "Yes", and the central processing unit checks the cue time counter to see whether or not the cue time is expired. There are two theoretical possibilities as similar to the second embodiment. The first possibility is that the key 1*c*/1*d* passes through the cue note-on key position after the cue time counter reached zero. (See the path from "yes" at step S49 through step S21 and "yes" at step S48 to "yes" at step S51.) The second possibility is that the cue time counter reaches zero after the key 1*c*/1*d* passed through the cue note-on key position. (See the path directly from "yes" at step S48 without execution at steps S49 and S50.)

When the cue time counter expresses zero, i.e., the answer at step S51 is given affirmative "Yes", the central processing unit sets the adjusting counter to a number of tempo clocks equivalent to the adjusting time as by step S52. The adjusting counter is periodically decremented through the computer program for count-down as indicated by CD2.

The central processing unit checks the adjusting counter to see whether or not the adjusting time is expired as by step S53. While the adjusting counter is being decremented, the answer is given negative "No". The central processing unit waits for the change of answer at step S53.

When the adjusting counter reaches zero, the answer at step S53 is given affirmative "Yes", and the central processing unit takes down the cue flag as by step S54. The cue time counter restarts to decrement the number of tempo clocks. When the cue time counter reaches zero, the central processing unit permits the key event code or codes to be transferred to the electronic tone generator 13 before proceeding to step S55.

On the other hand, when the human player gives rise to the movement of key 1*c*/1*d* before the cue time counter reaches zero, a certain number of tempo clocks is still stored in the cue tome counter, and the answer at step S51 is given negative "No". In this situation, the chord is to be immediately produced. The central processing unit permits the key event data codes to be transferred to the electronic tone generator 13, and proceeds to step S55.

The central processing unit checks the cue time track Tr15 to see whether or not any cue note is left in the cue time track Tr15. When the central processing unit finds another cue note and, accordingly, cue time, the central processing unit returns to step S41, and repeats the loop consisting of the step S41 to S55 and subroutine program SB12 for the new cue note and cue time.

On the other hand, if the central processing unit does not find any other cue note, the central processing unit returns to the remaining part of the automatic accompanying subroutine program, and does not enter the subroutine program shown in FIGS. 12A to 12C after the return.

As will be understood from the foregoing description, the automatic accompanist produces the tones of accompaniment at the timing proper to the progress of melody by adding the adjusting time to the constant time period, i.e., 15 milliseconds. The automatic accompanist varies the adjusting time depending upon the velocity of depressed keys 1*c*/1*d*. For this reason, the tones of accompaniment are always produced at the proper timing regardless of the key velocity.

Fourth Embodiment

Figure 13:
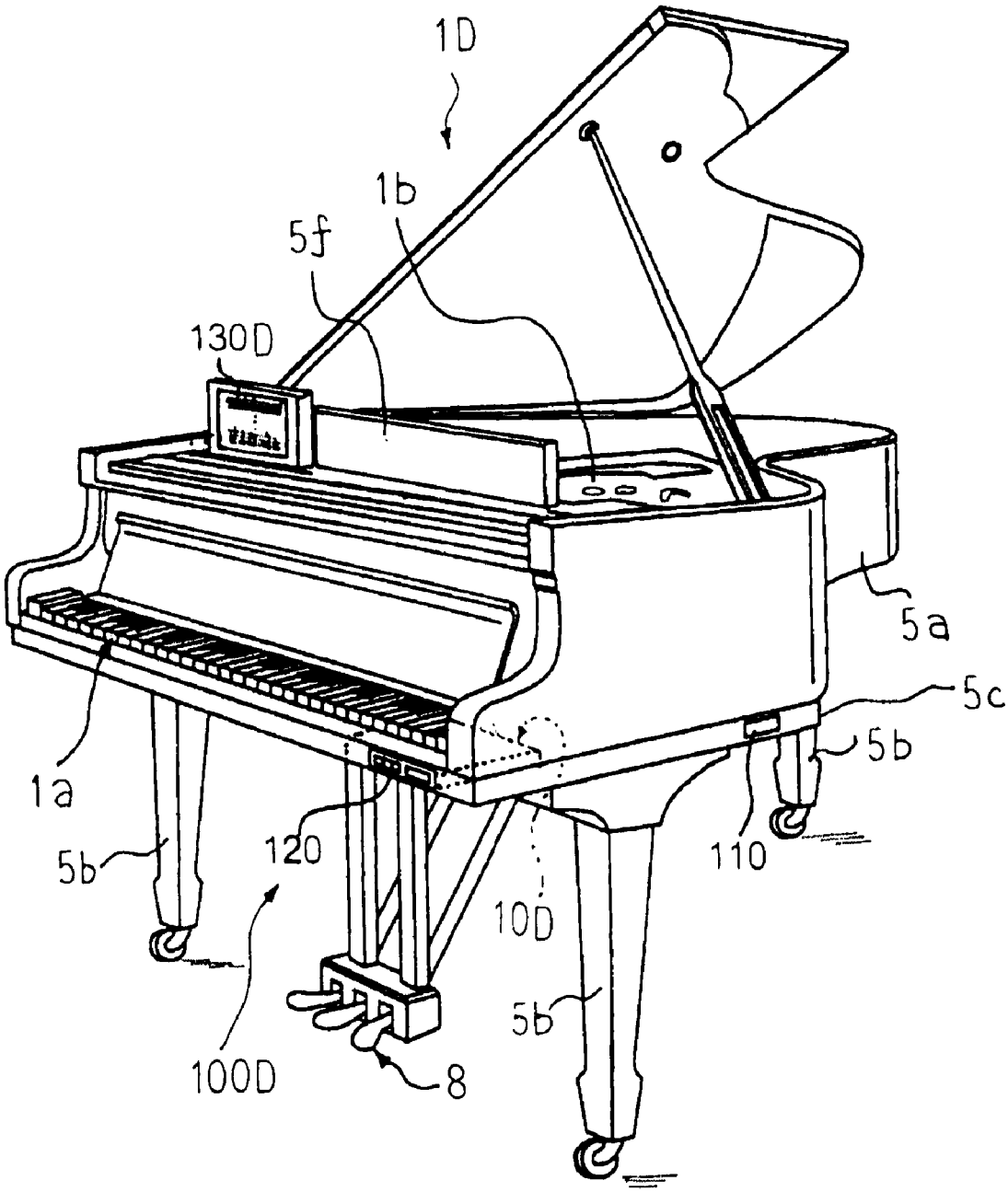
FIG. 13 is a perspective view showing still another automatic player piano of the present invention.

Turning to FIG. 13 of the drawings, still another automatic player piano embodying the present invention largely comprises a grand piano ID and an electronic system 100D. The grand piano is similar in structure to the grand piano 1 so that component parts are labeled with references designating corresponding component parts of the grand piano 1 without detailed description. Although a computer program, which is installed in an information processor 10D, is different from that installed in the information processor 10, the other system components of the electronic system 100D are similar to those of the electronic system 100. For this reason, the system components of electronic system 100D are labeled with references designating the corresponding system components of electronic system 100 except for a panel display 130D.

In the first embodiment, the track Tr15 is assigned to the cue time data codes and cue note data codes, and the automatic accompaniment is realized through the parallel data processing on the cue time data codes and cue note data codes in the cue time track Tr15 and the duration data codes and event data codes. Another cue time track Tr14 is added to the two tracks Tr1 and Tr15. The second cue time track Tr14 makes visual images on the panel display 130D synchronized with the fingering of a human player. In this instance, images of a score of a music tune are produced on the panel display 130D, and notes of sixteen bars on stuff form each picture on the panel display 130D.

A music data file includes not only the accompaniment track Tr1 and first cue time track Tr15 but also the second cue time track Tr14 as shown in FIG. 14. The accompaniment track Tr1 and first cue time track Tr15 are same as those shown in FIGS. 7A, 7B and 7C. The second cue time track Tr14 has cue time data codes and cue note data codes as similar to the first cue time track Tr15. The cue time data codes in the track Tr14 express values of the delta time or lapse of time until the next cue note. The cue notes in the track Tr14 are provided at notes one quarter note before the last notes of the sixteenth bar on each picture. Human players can change the notes at which the picture is changed through the panel display 130D. The first cue note in the second cue time track Tr14 is indicative of the number of tempo clocks equivalent to the lapse of time from the initiation of the fingering to the cue note on the first picture. In this instance, the first picture is changed to the second picture upon expiry of the delta time equivalent to 30,240 tempo clocks.

The central processing unit executes the subroutine program same as that described in conjunction with the cue time track Tr15 and another subroutine program for the second cue time track Tr14 in parallel to the first cue time track Tr15. The subroutine program for the second cue time track Tr14 is similar to that for the first cue time track Tr15. In order to prevent the central processing unit mistakenly find another depressed key assigned the pitch name same as that of the cue note, the central processing unit ignores the depressed key for a certain lapse of time from the first note on each page.

As will be understood, more than one cue track is prepared in a music data file for controlling another device as well as the progress of automatic accompaniment.

Fifth Embodiment

Figure 15:
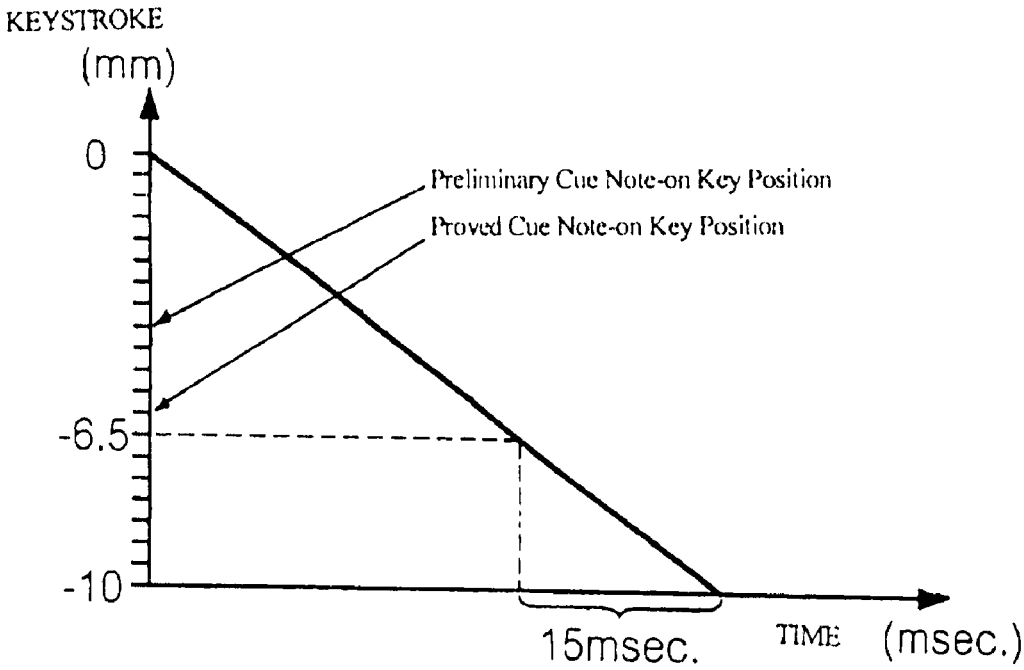
FIG. 15 is a graph showing a preliminary cue note-on key position and a proved cue note-on key position on a locus of a depressed key.

Yet another automatic player piano embodying the present invention has a structure and a system configuration similar to those of the first embodiment. However, an automatic accompanying subroutine program is partially different from that of the first embodiment to the fourth embodiment. Two cue note-on key positions are defined on each locus of depressed key as shown in FIG. 15. The cue note-on position, which is closer to the rest position, is referred to as a "preliminary cue note-on key position", and the other cue note-on position, which is deeper than the preliminary cue note-on key position" is referred to as "a proved cue note-on key position".

The automatic accompanying subroutine includes a subroutine programs corresponding to the subroutine programs shown in FIGS. 10A to 10C. However, the subroutine program, which is corresponding to that shown in FIGS. 10A and 10B, is partially different. When the depressed key 1*c*/1*d* passes through the preliminary cue note-on key position after the interruption of the cut time counter, the central processing unit restarts the cue time counter. If the depressed key passes through the provided cue note-on key position within a predetermined time period, the central processing unit permits the cue time counter to continue the measurement for the cue time. The predetermined time period is, by way of example, 5 milliseconds long. However, if the depressed key does not reach the provided cue note-on key position within the predetermined time period, the central processing unit determines that the human player mistakenly depresses the key 1*c*/1*d*, and stops the cue time counter. Thereafter, the central processing unit may decrease the cue time counter by the number of tempo clocks equivalent to 5 milliseconds. In case when only a note-on event data code or codes are transferred to the electronic tone generators 13, the note-on event data code or codes may be cancelled so as to prohibit the electronic tone generator 13 from continuously radiating the electronic tone or tones.

If the automatic accompanist is instructed to transfer the key event data codes to the motion controller 11, the central processing unit transfers the key event data codes to the motion controller 11 upon expiry of the lapse of time expressed by each duration data code. A depressed key 1*c*/1*d* is assumed not to reach the proved cue note-on key position within the predetermined time period after the transit through the preliminary cue note-on key position, the servo controller makes the depressed key return. Thus, the two cue note-on key position prevents the automatic accompanist from undesirable tone generation due to the mistakenly depressed key.

Although particular embodiments of the present invention have been shown and described, it will be apparent to those skilled in the art that various changes and modifications may be made without departing from the spirit and scope of the present invention.

The grand piano 1 does not set any limit to the technical scope of the present invention. The automatic accompanist may be installed in another sort of keyboard musical instrument such as, for example, an upright piano, a mute piano, a harpsichord and an organ. The mute piano is an acoustic piano, an electronic tone generating system and a hammer stopper. The hammer stopper is moved into the trajectories of hammers, and is moved out of the trajectories. While the hammer stopper is staying outside of the trajectories of hammers, a human player plays a music tune on the acoustic piano. When the hammer stopper is moved into the trajectories of hammers, the hammers rebound on the hammer stopper before reaching the strings. For this reason, any acoustic piano tone is produced. The electronic tone generator produces electronic tones corresponding to the acoustic piano tones, and the player hears the electronic tones through a headphone. The grand piano 1 may be replaced with an electronic keyboard. In this instance, a human player produces electronic tones through the fingering on the keyboard, and the automatic accompanist also produces the electronic tones on the basis of the music data codes in the automatic accompanying track Tr1.

The keyboard musical instrument does not set any limit to the technical scope of the present invention. The automatic accompanist may be installed in a percussion instrument such as, for example, a celesta.

The electronic tone generator 13 does not set any limit to the technical scope of the present invention. The accompaniment may be produced through the selective actuation of solenoid-operated key actuators 15.

The automatic accompanist may accompany a performance on a wind musical instrument with an electronic keyboard or an automatic player piano. In this instance, pressure sensors are fitted to the keys of the wind musical instrument.

The key sensors 14 may be replaced with hammer sensors. The hammer sensors monitor the hammers 2, and supply hammer position signals to the information processor 10.

The optical position transducer does not set any limit to the technical scope of the present invention. A velocity transducer or an acceleration sensor may be used as the key sensors 14. In this instance, the information processor converts the key velocity/key acceleration to the key position/key velocity through a suitable computer subroutine program, if necessary. The sensor may electromagnetically convert the physical quantity expressing the motion to an electric signal.

The light beams may have a cross section wider than the keystroke of the associated black and white keys 1*c*/1*d*. Otherwise, a photo-coupler may be provided at the cue note-on key position.

The keystroke of −6.5 millimeters does not set any limit to the technical scope of the present invention. The keystroke at which the interruption is canceled is dependent on a human player. For this reason, the human player may specify the keystroke at which the interruption is canceled through the panel display 130. Nevertheless, if the cue note-on key position is too shallow, the central processing unit may mistakenly recognize the quasi-key event at a miss-touch, i.e., the human player mistakenly depresses the key identical with the cue note. From this viewpoint, even if the automatic accompanist permits users to specify the cue note-on key positions through the panel display, the automatic accompanist teaches the shallowest key positions to the users.

In case an electronic tutor, who makes keys slightly sunk before the human player depresses, is further installed in the information processor, the cue note-on key positions are to be deeper than the guide key positions. An example of the electronic tutor is disclosed in Japan Patent Application laid-open No. 2000-194356.

The cue note-on key position may be different among the keys 1*c*/1*d* serving as the cue notes.

The cue note-on key position may be varied together with the key velocity in the key-on event data codes stored in the accompaniment track Tr1. In detail, when the tones of accompaniment are to be loudly produced, it is presumable that the human player loudly produces the tone. Therefore, it is possible to vary the cue note-on key position depending upon the key velocity of the key-on event data codes stored in the accompaniment track Tr1. The adjusting time may be presumed on the basis of the key velocity in the key-on event data codes.

If a track of the music data file is assigned to the tones of melody, it is possible to vary the cue note-on key position or adjusting time depending upon the key velocity stored in the key-on event data codes stored in the melody track.

Pieces of control data expressing the cue note-on key position or data expressing the adjusting time may be stored in the cue time track Tr15. In this instance, the cue note-on key position or adjusting time may be directly specified as the keystroke. Otherwise, the pieces of control data may express the key velocity so as to determine the cue note-on key position or adjusting time on the basis of the key velocity read out from the cue time track Tr15.

The images of score do not set any limit to the technical scope of the pre-sent invention. Pictures of landscape or pictures for a presentation may be produced on a panel display. Otherwise, a lighting system may be controlled for changing the color of spot light. In case where the mute piano is used, a user controls the panel display by means of the keys without any acoustic piano tone. Images of cue notes may be added to the images of stuff.

A panel display and/or a lighting system may be connected to the information processor 10D through an AUX (Auxiliary) terminal or a USB (Universal Serial Bus) terminal of the information processor.

When a human player depresses the key 1*c*/1*d* before expiry of a time period in the duration counter, the automatic accompanist may retard the transfer of the key event data codes until the duration counter reaches the predetermined number. In this instance, the automatic accompanist forces the human player to follow the automatic accompaniment.

The central processing unit may ignore a short time period left in the duration counter on the condition that the human player depresses the key 1*c*/1*d* corresponding to the cue note. In other words, the automatic accompanist permits the human player to play the melody only when the human player slightly advances the melody. The predetermined time period may be as short as half of a quarter note. However, the predetermined time period may be determined for each of the cue note in consideration of the length of the previous note. In this instance, the predetermined time period is written in the cue time track Tr15. This feature is desirable, because the automatic accompanist does not mistakenly acknowledge the cue note, even if the key 1*c*/1*d*, which is assigned the pitch name same as the cue note, may be repeatedly depressed for different time periods. If the previous note is assigned the pitch name same as the cue note, the predetermined time period is shorter than the length of the previous note. However, if the previous note is assigned the pitch name different from the cue note, it is possible to determine the predetermined time period longer than the previous note.

The cue time data codes and cue note data codes may be stored in the accompanying track Tr1 together with the duration data codes and key event data codes. In order the make the central processing unit discriminate the cue note data codes from the key event data codes, a certain tag may be added to the cue note data codes.

The MIDI protocols do not set any limit to the technical scope of the present invention. The pieces of music data may be coded in accordance with other protocols.

The built-in automatic accompanying system does not set any limit to the technical scope of the present invention. A portable automatic accompanying system, which is similar in system configuration to the built-in automatic accompanying systems described hereinbefore, may be physically independent of the automatic playing piano. When a user wishes to make the portable automatic accompanying system perform an accompaniment for a music tune performed by the user, the user connects the portable automatic playing system to the automatic player piano or an electronic keyboard.

The component parts of automatic player piano and the jobs in computer programs are correlated with claim languages as follows.

The black keys 1*c*, white keys 1*d*, action units 3, dampers 6 and hammers 2 as a whole constitute "plural link-works", and the pitch of tones is corresponding to "an attribute". The notes C3, A3 and G3 are "tones", and chords Chord 1, Chord 2, Chord 3 are "accompanying tones".

The strings 4 and electronic tone generator 13 form in combination "a tone generator". The "tone generator" is corresponding to the strings 4, motion controller 11, servo controller 12 and solenoid-operated key actuators 15 in case where the human player instructs the automatic player to produce the tones for the accompaniment.

The random access memory, in which the music data file having the tracks Tr1 and Tr15 or the tracks Tr1, Tr14 and Tr15 is stored, serves as "a data storage". The key event data codes and duration data codes in the accompanying track Tr1 have "pieces of music data" and "pieces of time data", and the cue note data codes and cue time data codes in the cue time track Tr15 have "pieces of cue note data" and "pieces of cue time data".

"A first time keeper" is realized by the key sensors 14, information processor 10 and computer program having the jobs at steps S1 to S4, the key sensors 14, information processor 10 and computer program having the jobs at steps S11 to S15, S17 to S20, S22, S24, S31 to S35 and CD or the key sensors 14, information processor 10 and computer program having the jobs at steps S41 to S45, S47 to S49, S51, S55 and CD1.

"A second time keeper" is realized by the information processor 10 and computer programs having the jobs described in conjunction with the transfer of the key event data codes to the electronic tone generator 13, or the information processor 10 and computer program having the jobs at steps S61 to S66, S52, S53 and CD2 and jobs described in conjunction with the transfer of the key event data codes to the electronic tone generator 13. The positive answer "Yes" and negative answer "No" at step S2, the positive answer "Yes" and negative answer "No" at steps S20 and S22, or the positive answer "Yes" and negative answer "No" at steps S49 and S51 serve as "pieces of control data".

"An interrupter" is realized by the information processor 10 and computer programs having the jobs at steps S21 and S23, or the information processor 10 and computer program having the jobs at steps S50 and S54.

What is claimed is:

1. A musical instrument for performing a music tune, comprising:

plural link-works selectively actuated by a human player so as to specify an attribute of tones to be produced and tone producing moments at which said tones are produced;

a tone generator connected to said plural link-works so as to produce said tones at said moments;

an automatic accompanying system including a data storage storing pieces of music data expressing accompanying tones to be produced, pieces of time data expressing accompanying tone producing moments to produce said accompanying tones, pieces of cue note data expressing selected ones of said tones to be produced by said human player and pieces of cue time data expressing the tone producing moments at which said human player is expected to produce said selected ones of said tones, a first time keeper connected to said data storage so as to read out said pieces of cue note data and said pieces of cue time data and monitoring said link-works expressed by said pieces of said cue note data so as to produce pieces of control data expressing whether or not said human player activates said link-works at or before said tone producing moments expressed by said pieces of cue time data, a second time keeper connected to said tone generator and said data storage so as to read out said pieces of music data and said pieces of time data and supplying said pieces of music data to said tone generator for causing said tone generator to produce said accompanying tones when said accompanying tone producing moments come, and an interrupter connected to said first time keeper and said second time keeper and responsive to said pieces of control data so as to interrupt the passage of time toward said accompanying tone producing moments while the answer of said first time keeper is being given negative.

2. The musical instrument as set forth in claim 1, in which the first piece of cue note data and associated one of said pieces of cue time data are indicative of the first note at the head of said music tune and a moment at which said human player activates the link-work expressed by said first piece of cue note data, respectively, so that said automatic accompanying system automatically starts the accompaniment upon the activation of said link-work.

3. The musical instrument as set forth in claim 2, in which said associated one of said pieces of cue time data expresses a lapse of time equal to zero from the activation of said automatic accompanying system so that said interrupter releases said second time keeper from the interruption of said progress of time from said activation of said automatic accompanying system to the accompanying tone producing moment when said human player activates said link-work expressed by said first piece of cue note data.

4. The musical instrument as set forth in claim 1, in which said first time keeper determines the activation of said link-works expressed by said pieces of cue note data at cue note-on positions closer to rest positions of said plural link-works than data transfer positions at which said second time keeper transfers said pieces of music data to said tone generator.

5. The musical instrument as set forth in claim 4, in which a lapse of time between said cue note-on position and said tone generating positions is equal to a time period consumed by said first time keeper and said interrupter.

6. The musical instrument as set forth in claim 5, in which said cue note-on positions are varied depending upon velocity of said link-works after said activation.

7. The musical instrument as set forth in claim 5, in which said cue note-on positions are fixed to certain positions on loci traced by said link-works in said activation, and said lapse of time is varied depending upon velocity of said link-works after said activation.

8. The musical instrument as set forth in claim 4, in which said first time keeper changes the answer from positive to negative, again, if said link-works do not reach proved cue note-on positions between said cue note-on positions and said data transfer positions within a certain time period.

9. The musical instrument as set forth in claim 1, in which said pieces of cue note data and said pieces of cue time data are stored in a track different from another track assigned to said pieces of music data and said pieces of duration data, and said track is labeled with a caption different from another caption of said another track so as to prohibit said second time keeper from read-out of said pieces of cue note data from said track.

10. The musical instrument as set forth in claim 9, in which said pieces of music data and said pieces of time data are produced in accordance with protocols shared with other pieces of music data and other pieces of time data for producing tones through another musical instrument without said automatic accompanying system.

11. The musical instrument as set forth in claim 1, in which said tone generator has a mechanical tone generator for producing said tones through vibrations of component parts thereof exited by said human player and an electronic tone generator for electronically producing said accompanying tones from an electric audio signal produced on the basis of said pieces of music data.

12. The musical instrument as set forth in claim 11, in which said vibrations are excited at collisions between said component parts and other component parts of said mechanical tone generator.

13. An automatic accompanying system for producing accompanying tones to a music passage performed by a human player on a musical instrument, comprising:

a data storage storing pieces of music data expressing said accompanying tones, pieces of time data expressing accompanying tone producing moments to produce said accompanying tones, pieces of cue note data expressing selected ones of the tones in said music passage and pieces of cue time data expressing tone producing moments at which said human player is expected to produce said selected ones of said tones, a first time keeper connected to said data storage so as to read out said pieces of cue note data and said pieces of cue time data and monitoring link-works of said musical instrument expressed by said pieces of said cue note data so as to produce pieces of control data expressing whether or not said human player activates said link-works at or before said tone producing moments expressed by said pieces of cue time data, a second time keeper connected to said tone generator and said data storage so as to read out said pieces of music data and said pieces of time data and supplying said pieces of music data to said tone generator for causing said tone generator to produce said accompanying tones when said accompanying tone producing moments come, and an interrupter connected to said first time keeper and said second time keeper and responsive to said pieces of control data so as to interrupt the passage of time toward said accompanying tone producing moments while the answer of said first time keeper is being given negative.

14. The automatic accompanying system as set forth in claim 13, in which the first piece of cue note data and associated one of said pieces of cue time data are indicative of the first note at the head of said music tune and a moment at which said human player activates the link-work expressed by said first piece of cue note data, respectively, so that said automatic accompanying system automatically starts the accompaniment upon the activation of said link-work.

15. The automatic accompanying system as set forth in claim 14, in which said associated one of said pieces of cue time data expresses a lapse of time equal to zero from the activation of said automatic accompanying system so that said interrupter releases said second time keeper from the interruption of said progress of time from said activation of said automatic accompanying system to the accompanying tone producing moment when said human player activates said link-work expressed by said first piece of cue note data.

16. The automatic accompanying system as set forth in claim 13, in which said first time keeper determines the activation of said link-works expressed by said pieces of cue note data at cue note-on positions closer to rest positions of said plural link-works than data transfer positions at which said second time keeper transfers said pieces of music data to said tone generator.

17. The automatic accompanying system as set forth in claim 16, in which a lapse of time between said cue note-on position and said tone generating positions is equal to a time period consumed by said first time keeper and said interrupter.

18. The automatic accompanying system as set forth in claim 17, in which said cue note-on positions are varied depending upon velocity of said link-works after said activation.

19. The automatic accompanying system as set forth in claim 17, in which said cue note-on positions are fixed to certain positions on loci traced by said link-works in said activation, and said lapse of time is varied depending upon velocity of said link-works after said activation.

20. The automatic accompanying system as set forth in claim 16, in which said first time keeper changes the answer from positive to negative, again, if said link-works do not reach proved cue note-on positions between said cue note-on positions and said data transfer positions within a certain time period.

* * * * *